US010352540B2

(12) United States Patent
Jiang et al.

(10) Patent No.: US 10,352,540 B2
(45) Date of Patent: Jul. 16, 2019

(54) LED TUBE LAMP

(71) Applicant: JIAXING SUPER LIGHTING ELECTRIC APPLIANCE CO., LTD, Zhejiang (CN)

(72) Inventors: Tao Jiang, Zhejiang (CN); Li-Qin Li, Zhejiang (CN); Hong Xu, Zhejiang (CN)

(73) Assignee: JIAXING SUPER LIGHTING ELECTRIC APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 15/437,084

(22) Filed: Feb. 20, 2017

(65) Prior Publication Data

US 2017/0159894 A1 Jun. 8, 2017

Related U.S. Application Data

(63) Continuation-in-part of application No. PCT/CN2015/096502, filed on Dec. 5, 2015, and a (Continued)

(30) Foreign Application Priority Data

Dec. 5, 2014 (CN) ..... 2014 1 0734425
Feb. 12, 2015 (CN) ..... 2015 1 0075925
(Continued)

(51) Int. Cl.
*F21V 23/02* (2006.01)
*F21V 23/00* (2015.01)
(Continued)

(52) U.S. Cl.
CPC ..... *F21V 23/00* (2013.01); *F21K 9/27* (2016.08); *F21K 9/272* (2016.08); *F21K 9/275* (2016.08);
(Continued)

(58) Field of Classification Search
CPC ..... F21K 9/275; F21K 9/272; F21K 9/278; F21K 9/27; F21V 3/0615; F21V 3/10;
(Continued)

(56) References Cited

U.S. PATENT DOCUMENTS 2,454,049 A 11/1948 Floyd, Jr.
3,294,518 A 12/1966 Laseck et al.
(Continued)

FOREIGN PATENT DOCUMENTS

CN 1292930 A 4/2001
CN 1460165 A 12/2003
(Continued)

OTHER PUBLICATIONS

Hsin-Hung Chan, Improved Light Output and Electrical Performance of GaN-Based Light-Emitting Diodes by Surface Roughening, Master thesis, Graduate Institute of Precision Engineering, National Chung-Hsing University, Taiwan R.O.C. (2006).

*Primary Examiner* — Ali Alavi
(74) *Attorney, Agent, or Firm* — Andrew M. Calderon; Roberts Mlotkowski Safran Cole & Calderon, P.C.

(57) ABSTRACT

An LED tube lamp including a glass lamp tube, an end cap disposed at one end of the glass lamp tube, a power supply provided inside the end cap, an LED light strip disposed inside the glass lamp tube with a plurality of LED light sources mounted on. At least a part of an inner surface of the glass lamp tube is formed with a rough surface, and the glass lamp tube is covered by a heat shrink sleeve. The LED light strip has a bendable circuit sheet which is made of a metal layer structure to electrically connect the LED light sources with the power supply. The glass lamp tube and the end cap are secured by a highly thermal conductive silicone gel with its thermal conductivity not less than 0.7 w/m·k.

23 Claims, 13 Drawing Sheets

Related U.S. Application Data continuation of application No. 15/056,106, filed on Feb. 29, 2016, now Pat. No. 9,903,537.

(30) Foreign Application Priority Data

| | | |
|---|---|---|
| Mar. 27, 2015 | (CN) | 2015 1 0136796 |
| May 19, 2015 | (CN) | 2015 1 0259151 |
| Jun. 12, 2015 | (CN) | 2015 1 0324394 |
| Jun. 17, 2015 | (CN) | 2015 1 0338027 |
| Jun. 26, 2015 | (CN) | 2015 1 0373492 |
| Jul. 27, 2015 | (CN) | 2015 1 0448220 |
| Aug. 7, 2015 | (CN) | 2015 1 0482944 |
| Aug. 8, 2015 | (CN) | 2015 1 0483475 |
| Aug. 14, 2015 | (CN) | 2015 1 0499512 |
| Sep. 2, 2015 | (CN) | 2015 1 0555543 |
| Sep. 6, 2015 | (CN) | 2015 1 0557717 |
| Sep. 18, 2015 | (CN) | 2015 1 0595173 |
| Oct. 8, 2015 | (CN) | 2015 1 0645134 |
| Oct. 29, 2015 | (CN) | 2015 1 0716899 |
| Oct. 30, 2015 | (CN) | 2015 1 0726365 |
| Dec. 2, 2015 | (CN) | 2015 1 0868263 |

(51) Int. Cl.

| | |
|---|---|
| ***F21V 3/06*** | (2018.01) |
| ***F21V 3/10*** | (2018.01) |
| ***F21V 25/04*** | (2006.01) |
| ***F21V 7/00*** | (2006.01) |
| ***F21V 29/83*** | (2015.01) |
| ***F21V 15/015*** | (2006.01) |
| ***F21V 17/10*** | (2006.01) |
| ***F21V 19/00*** | (2006.01) |
| ***F21K 9/27*** | (2016.01) |
| ***F21K 9/272*** | (2016.01) |
| ***F21K 9/275*** | (2016.01) |
| ***F21K 9/278*** | (2016.01) |
| ***F21V 3/02*** | (2006.01) |
| ***F21V 31/00*** | (2006.01) |
| *F21Y 103/10* | (2016.01) |
| *F21Y 115/10* | (2016.01) |

(52) U.S. Cl.

CPC ..... *F21K 9/278* (2016.08); *F21V 3/02* (2013.01); *F21V 3/061* (2018.02); *F21V 3/0615* (2018.02); *F21V 3/10* (2018.02); *F21V 7/005* (2013.01); *F21V 15/015* (2013.01); *F21V 17/101* (2013.01); *F21V 19/009* (2013.01); *F21V 23/02* (2013.01); *F21V 23/023* (2013.01); *F21V 25/04* (2013.01); *F21V 29/83* (2015.01); *F21V 31/005* (2013.01); *F21Y 2103/10* (2016.08); *F21Y 2115/10* (2016.08)

(58) Field of Classification Search

CPC ..... F21V 3/02; F21V 3/0427; F21V 3/0472; F21V 17/101; F21V 31/005; F21V 23/00; F21V 29/83; F21V 3/061; F21V 7/005; F21V 15/015; F21V 19/009; F21V 23/02; F21V 23/023; F21V 25/04; F21Y 2103/10; F21Y 2115/10

See application file for complete search history.

(56) References Cited

U.S. PATENT DOCUMENTS

| | | | | |
|---|---|---|---|---|
| 4,156,265 | A | 5/1979 | Rose | |
| 4,647,399 | A | 3/1987 | Peters et al. | |
| 5,575,459 | A | 11/1996 | Anderson | |
| 5,921,660 | A | 7/1999 | Yu | |
| 6,043,600 | A * | 3/2000 | Sica | H01J 5/12 313/112 |
| 6,118,072 | A | 9/2000 | Scott | |
| 6,127,783 | A | 10/2000 | Pashley et al. | |
| 6,186,649 | B1 | 2/2001 | Zou et al. | |
| 6,211,262 | B1 | 4/2001 | Mejiritski et al. | |
| 6,609,813 | B1 | 8/2003 | Showers et al. | |
| 6,796,680 | B1 | 9/2004 | Showers et al. | |
| 6,860,628 | B2 | 3/2005 | Robertson et al. | |
| 6,936,855 | B1 | 8/2005 | Harrah et al. | |
| 7,033,239 | B2 | 4/2006 | Cunkelman et al. | |
| 7,067,032 | B1 | 6/2006 | Bremont et al. | |
| 7,594,738 | B1 | 9/2009 | Lin et al. | |
| 7,611,260 | B1 | 11/2009 | Lin et al. | |
| 8,360,599 | B2 * | 1/2013 | Ivey | F21V 23/06 362/218 |
| 8,456,075 | B2 | 6/2013 | Axelsson | |
| 8,579,463 | B2 | 11/2013 | Clough | |
| 9,000,668 | B2 | 4/2015 | Qiu | |
| 9,288,867 | B2 | 3/2016 | Hsia et al. | |
| 9,322,531 | B2 | 4/2016 | Liang et al. | |
| D761,216 | S | 7/2016 | Jiang | |
| 9,447,929 | B2 | 9/2016 | Jiang | |
| 9,448,660 | B2 | 9/2016 | Seo et al. | |
| D768,891 | S | 10/2016 | Jiang et al. | |
| 9,618,168 | B1 | 4/2017 | Jiang et al. | |
| 9,625,137 | B2 | 4/2017 | Li et al. | |
| D797,323 | S | 9/2017 | Yang et al. | |
| 9,864,438 | B2 | 1/2018 | Seo et al. | |
| 10,021,742 | B2 | 7/2018 | Jiang | |
| 2002/0044456 | A1 | 4/2002 | Balestriero et al. | |
| 2003/0189829 | A1 | 10/2003 | Shimizu et al. | |
| 2003/0231485 | A1 | 12/2003 | Chien | |
| 2004/0095078 | A1 | 5/2004 | Leong | |
| 2004/0189218 | A1 | 9/2004 | Leong et al. | |
| 2005/0128751 | A1 | 6/2005 | Roberge et al. | |
| 2005/0162101 | A1 | 7/2005 | Leong et al. | |
| 2005/0162850 | A1 | 7/2005 | Luk et al. | |
| 2005/0168123 | A1 | 8/2005 | Taniwa | |
| 2005/0185396 | A1 | 8/2005 | Kutler | |
| 2005/0207166 | A1 | 9/2005 | Kan et al. | |
| 2005/0213321 | A1 | 9/2005 | Lin | |
| 2006/0028837 | A1 | 2/2006 | Mrakovich et al. | |
| 2007/0001709 | A1 | 1/2007 | Shen | |
| 2007/0145915 | A1 | 6/2007 | Roberge et al. | |
| 2007/0210687 | A1 | 9/2007 | Axelsson | |
| 2007/0274084 | A1 | 11/2007 | Kan et al. | |
| 2008/0030981 | A1 | 2/2008 | Mrakovich et al. | |
| 2008/0055894 | A1 | 3/2008 | Deng et al. | |
| 2008/0192476 | A1 | 8/2008 | Hiratsuka | |
| 2008/0278941 | A1 | 11/2008 | Logan et al. | |
| 2008/0290814 | A1 | 11/2008 | Leong et al. | |
| 2008/0302476 | A1 | 12/2008 | Bommi et al. | |
| 2009/0140271 | A1 | 6/2009 | Sah | |
| 2009/0159919 | A1 | 6/2009 | Simon et al. | |
| 2009/0161359 | A1 * | 6/2009 | Siemiet | F21S 4/28 362/235 |
| 2009/0219713 | A1 * | 9/2009 | Siemiet | F21V 3/02 362/218 |
| 2010/0066230 | A1 | 3/2010 | Lin et al. | |
| 2010/0085772 | A1 | 4/2010 | Song et al. | |
| 2010/0177532 | A1 | 7/2010 | Simon et al. | |
| 2010/0201269 | A1 | 8/2010 | Tzou | |
| 2010/0220469 | A1 | 9/2010 | Ivey et al. | |
| 2010/0253226 | A1 | 10/2010 | Oki | |
| 2010/0277918 | A1 | 11/2010 | Chen et al. | |
| 2011/0038146 | A1 | 2/2011 | Chen | |
| 2011/0057572 | A1 | 3/2011 | Kit et al. | |
| 2011/0084554 | A1 | 4/2011 | Tian et al. | |
| 2011/0084608 | A1 | 4/2011 | Lin et al. | |
| 2011/0084627 | A1 | 4/2011 | Sloan et al. | |
| 2011/0090684 | A1 | 4/2011 | Logan et al. | |
| 2011/0149563 | A1 | 6/2011 | Hsia et al. | |
| 2011/0216538 | A1 | 9/2011 | Logan et al. | |
| 2011/0279063 | A1 | 11/2011 | Wang et al. | |
| 2011/0305021 | A1 | 12/2011 | Chang | |

(56) References Cited

U.S. PATENT DOCUMENTS

| | | | | |
|---|---|---|---|---|
| 2011/0305024 | A1* | 12/2011 | Chang | F21V 5/02 362/294 |
| 2011/0309745 | A1 | 12/2011 | Westermarck | |
| 2012/0026761 | A1 | 2/2012 | Young | |
| 2012/0049684 | A1 | 3/2012 | Bodenstein et al. | |
| 2012/0069556 | A1 | 3/2012 | Bertram et al. | |
| 2012/0106144 | A1* | 5/2012 | Chang | F21K 9/17 362/218 |
| 2012/0106157 | A1 | 5/2012 | Simon et al. | |
| 2012/0146503 | A1 | 6/2012 | Negley et al. | |
| 2012/0153873 | A1 | 6/2012 | Hayashi et al. | |
| 2012/0169968 | A1 | 7/2012 | Ishimori et al. | |
| 2012/0212951 | A1 | 8/2012 | Chung-Ming et al. | |
| 2012/0293991 | A1 | 11/2012 | Lin | |
| 2012/0319150 | A1 | 12/2012 | Shimomura et al. | |
| 2013/0021809 | A1 | 1/2013 | Dellian et al. | |
| 2013/0033881 | A1 | 2/2013 | Terazawa et al. | |
| 2013/0033888 | A1 | 2/2013 | Wel et al. | |
| 2013/0050998 | A1 | 2/2013 | Chu et al. | |
| 2013/0069538 | A1 | 3/2013 | So | |
| 2013/0094200 | A1 | 4/2013 | Dellian et al. | |
| 2013/0135852 | A1 | 5/2013 | Chan | |
| 2013/0135857 | A1 | 5/2013 | Chen et al. | |
| 2013/0170196 | A1 | 7/2013 | Huang et al. | |
| 2013/0170245 | A1 | 7/2013 | Hong et al. | |
| 2013/0182425 | A1 | 7/2013 | Seki et al. | |
| 2013/0223053 | A1 | 8/2013 | Liu et al. | |
| 2013/0230995 | A1 | 9/2013 | Ivey et al. | |
| 2013/0235570 | A1 | 9/2013 | Hood et al. | |
| 2013/0250565 | A1 | 9/2013 | Chiang et al. | |
| 2013/0256704 | A1 | 10/2013 | Hsiao et al. | |
| 2013/0258650 | A1 | 10/2013 | Sharrah | |
| 2013/0293098 | A1 | 11/2013 | Li et al. | |
| 2014/0071667 | A1 | 3/2014 | Hayashi et al. | |
| 2014/0153231 | A1 | 6/2014 | Bittmann | |
| 2014/0192526 | A1 | 7/2014 | Qiu | |
| 2014/0225519 | A1 | 8/2014 | Yu | |
| 2014/0226320 | A1 | 8/2014 | Halliwell et al. | |
| 2015/0009688 | A1 | 1/2015 | Timmermans et al. | |
| 2015/0070885 | A1 | 3/2015 | Petro et al. | |
| 2015/0176770 | A1 | 6/2015 | Wilcox et al. | |
| 2015/0327368 | A1 | 11/2015 | Su | |
| 2015/0345755 | A1 | 12/2015 | Purdy | |
| 2016/0091147 | A1 | 3/2016 | Jiang et al. | |
| 2016/0091156 | A1 | 3/2016 | Li et al. | |
| 2016/0091179 | A1 | 3/2016 | Jiang et al. | |
| 2016/0178137 | A1 | 6/2016 | Jiang | |
| 2016/0178138 | A1 | 6/2016 | Jiang | |
| 2016/0215936 | A1 | 7/2016 | Jiang | |
| 2016/0215937 | A1 | 7/2016 | Jiang | |
| 2016/0290566 | A1 | 10/2016 | Jiang et al. | |
| 2016/0290567 | A1 | 10/2016 | Jiang et al. | |
| 2016/0290568 | A1 | 10/2016 | Jiang et al. | |
| 2016/0290569 | A1 | 10/2016 | Jiang et al. | |
| 2016/0290570 | A1 | 10/2016 | Jiang et al. | |
| 2016/0290598 | A1 | 10/2016 | Jiang | |
| 2016/0290609 | A1 | 10/2016 | Jiang | |
| 2016/0295706 | A1 | 10/2016 | Jiang | |
| 2016/0341414 | A1 | 11/2016 | Jiang | |
| 2017/0038012 | A1 | 2/2017 | Jiang et al. | |
| 2017/0038013 | A1 | 2/2017 | Jiang et al. | |
| 2017/0038014 | A1 | 2/2017 | Jiang et al. | |
| 2017/0089521 | A1 | 3/2017 | Jiang | |
| 2017/0130911 | A1 | 5/2017 | Li et al. | |
| 2017/0159894 | A1 | 6/2017 | Jiang et al. | |
| 2017/0167664 | A1 | 6/2017 | Li et al. | |
| 2017/0211753 | A1 | 7/2017 | Jiang et al. | |
| 2017/0219169 | A1 | 8/2017 | Jiang | |
| 2017/0290119 | A1 | 10/2017 | Xiong et al. | |
| 2017/0311398 | A1 | 10/2017 | Jiang et al. | |

FOREIGN PATENT DOCUMENTS

| | | | |
|---|---|---|---|
| CN | 1914458 | A | 2/2007 |
| CN | 200980183 | Y | 11/2007 |
| CN | 101092545 | A | 12/2007 |
| CN | 201014273 | Y | 1/2008 |
| CN | 201014273 | Y | 1/2008 |
| CN | 101228393 | A | 7/2008 |
| CN | 201363601 | | 12/2009 |
| CN | 201437921 | | 4/2010 |
| CN | 201437921 | U | 4/2010 |
| CN | 101787273 | A | 7/2010 |
| CN | 201555053 | U | 8/2010 |
| CN | 102016661 | A | 4/2011 |
| CN | 102052652 | | 5/2011 |
| CN | 201866575 | U | 6/2011 |
| CN | 102116460 | | 7/2011 |
| CN | 102121578 | | 7/2011 |
| CN | 201954169 | U | 8/2011 |
| CN | 201954350 | U | 8/2011 |
| CN | 202120982 | U | 1/2012 |
| CN | 202125774 | | 1/2012 |
| CN | 102359697 | A | 2/2012 |
| CN | 202216003 | | 5/2012 |
| CN | 102518972 | | 6/2012 |
| CN | 102518972 | A | 6/2012 |
| CN | 202302841 | | 7/2012 |
| CN | 202392485 | U | 8/2012 |
| CN | 102720901 | | 10/2012 |
| CN | 102720901 | A | 10/2012 |
| CN | 102777788 | | 11/2012 |
| CN | 102777788 | A | 11/2012 |
| CN | 202546288 | U | 11/2012 |
| CN | 102889446 | | 1/2013 |
| CN | 102889446 | A | 1/2013 |
| CN | 202791824 | U | 3/2013 |
| CN | 103016984 | A | 4/2013 |
| CN | 202884614 | U | 4/2013 |
| CN | 103195999 | A | 7/2013 |
| CN | 203068187 | | 7/2013 |
| CN | 203202766 | U | 9/2013 |
| CN | 203240337 | | 10/2013 |
| CN | 203240337 | U | 10/2013 |
| CN | 203240362 | U | 10/2013 |
| CN | 203363984 | | 12/2013 |
| CN | 203384716 | U | 1/2014 |
| CN | 203413396 | U | 1/2014 |
| CN | 203453866 | U | 2/2014 |
| CN | 203464014 | | 3/2014 |
| CN | 103742875 | | 4/2014 |
| CN | 203517629 | U | 4/2014 |
| CN | 203549435 | | 4/2014 |
| CN | 203585876 | U | 5/2014 |
| CN | 203615157 | | 5/2014 |
| CN | 203615157 | U | 5/2014 |
| CN | 103851547 | | 6/2014 |
| CN | 103851547 | A | 6/2014 |
| CN | 103943752 | A | 7/2014 |
| CN | 203771102 | | 8/2014 |
| CN | 203771102 | U | 8/2014 |
| CN | 203797382 | | 8/2014 |
| CN | 104033772 | | 9/2014 |
| CN | 203848055 | U | 9/2014 |
| CN | 203927469 | | 11/2014 |
| CN | 203927469 | U | 11/2014 |
| CN | 203963553 | U | 11/2014 |
| CN | 203963553 | U | 11/2014 |
| CN | 204042527 | | 12/2014 |
| CN | 204083927 | U | 1/2015 |
| CN | 204201535 | U | 3/2015 |
| CN | 104565931 | A | 4/2015 |
| CN | 204268162 | | 4/2015 |
| CN | 204268162 | U | 4/2015 |
| CN | 204300737 | | 4/2015 |
| CN | 104595765 | | 5/2015 |
| CN | 204420636 | | 6/2015 |
| CN | 104776332 | | 7/2015 |
| CN | 104832813 | A | 8/2015 |
| CN | 204534210 | U | 8/2015 |

(56) References Cited

FOREIGN PATENT DOCUMENTS

| | | | |
|---|---|---|---|
| CN | 204573639 | | 8/2015 |
| CN | 204573700 | U | 8/2015 |
| CN | 205447315 | U | 8/2016 |
| EP | 3146803 | | 3/2017 |
| GB | 2519258 | | 4/2015 |
| GB | 2523275 | | 8/2015 |
| GB | 2531425 | | 4/2016 |
| JP | 2008117666 | | 5/2008 |
| JP | 3147313 | U | 12/2008 |
| JP | 2011061056 | | 3/2011 |
| JP | 2013254667 | A | 12/2013 |
| JP | 2014154479 | | 8/2014 |
| JP | 2014154479 | A | 8/2014 |
| KR | 20120000551 | | 1/2012 |
| KR | 1020120055349 | | 5/2012 |
| WO | 2009111098 | A2 | 9/2009 |
| WO | 2011132120 | | 10/2011 |
| WO | 2012129301 | | 9/2012 |
| WO | 2013125803 | | 8/2013 |
| WO | 2014001475 | | 1/2014 |
| WO | 2014117435 | | 8/2014 |
| WO | 2014118754 | | 8/2014 |
| WO | 2015036478 | | 3/2015 |
| WO | 2015081809 | | 6/2015 |
| WO | 2016086901 | | 6/2016 |

* cited by examiner

LED TUBE LAMP

CROSS-REFERENCE TO RELATED APPLICATIONS

This application is a continuation application claiming benefit of non-provisional application Ser. No. 15/056,106, filed on 2016 Feb. 29, which is a continuation-in-part application claiming benefit of PCT Application No. PCT/CN2015/096502, filed on 2015 Dec. 5, which claims priority to Chinese Patent Applications No. CN 201410734425.5 filed on 2014 Dec. 5; CN 201510075925.7 filed on 2015 Feb. 12; CN 201510136796.8 filed on 2015 Mar. 27; CN 201510259151.3 filed on 2015 May 19; CN 201510324394.0 filed on 2015 Jun. 12; CN 201510338027.6 filed on 2015 Jun. 17; CN 201510373492.3 filed on 2015 Jun. 26; CN 201510448220.5 filed on 2015 Jul. 27; CN 201510482944.1 filed on 2015 Aug. 7; CN 201510483475.5 filed on 2015 Aug. 8; CN 201510499512.1 filed on 2015 Aug. 14; CN 201510555543.4 filed on 2015 Sep. 2; CN 201510645134.3 filed on 2015 Oct. 8; CN 201510716899.1 filed on 2015 Oct. 29, and CN 201510868263.9 filed on 2015 Dec. 2, the disclosures of which are incorporated herein in their entirety by reference.

FIELD OF THE INVENTION

The present disclosure relates to illumination devices, and more particularly to an LED tube lamp and its components including the light sources, electronic components, and end caps.

BACKGROUND OF THE INVENTION

LED lighting technology is rapidly developing to replace traditional incandescent and fluorescent lightings. LED tube lamps are mercury-free in comparison with fluorescent tube lamps that need to be filled with inert gas and mercury. Thus, it is not surprising that LED tube lamps are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when taking into account all factors, they would typically be considered as a cost effective lighting option.

Typical LED tube lamps have a lamp tube, a circuit board disposed inside the lamp tube with light sources being mounted on the circuit board, and end caps accompanying a power supply provided at two ends of the lamp tube with the electricity from the power supply transmitting to the light sources through the circuit board. However, existing LED tube lamps have certain drawbacks.

First, the typical circuit board is rigid and allows the entire lamp tube to maintain a straight tube configuration when the lamp tube is partially ruptured or broken, and this gives the user a false impression that the LED tube lamp remains usable and is likely to cause the user to be electrically shocked upon handling or installation of the LED tube lamp.

Second, the rigid circuit board is typically electrically connected with the end caps by way of wire bonding, in which the wires may be easily damaged and even broken due to any move during manufacturing, transportation, and usage of the LED tube lamp and therefore may disable the LED tube lamp.

Third, grainy visual appearances are also often found in the aforementioned typical LED tube lamp. The LED chips spatially arranged on the circuit board inside the lamp tube are considered as spot light sources, and the lights emitted from these LED chips generally do not contribute uniform illuminance for the LED tube lamp without proper optical manipulation. As a result, the entire tube lamp would exhibit a grainy or non-uniform illumination effect to a viewer of the LED tube lamp, thereby negatively affecting the visual comfort and even narrowing the viewing angles of the lights. As a result, the quality and aesthetics requirements of average consumers would not be satisfied. To address this issue, the Chinese patent application with application no. CN 201320748271.6 discloses a diffusion tube is disposed inside a glass lamp tube to avoid grainy visual effects.

However, the disposition of the diffusion tube incurs an interface on the light transmission path to increase the likelihood of total reflection and therefore decrease the light outputting efficiency. In addition, the optical rotatory absorption of the diffusion tube decreases the light outputting efficiency.

Moreover, there is another technology used in the field of LED chip manufacturing for improving output of light by surface roughening as disclosed in the Master Thesis of Mr. Chen. This thesis describes the surface texturization of p-GaN, LED chip, surface using a combination of Ni natural lithography and wet etching techniques. (Please see Hsin-Hung Chan, "Improved Light Output and Electrical Performance of GaN-Based Light-Emitting Diodes by Surface Roughening", Master thesis, Graduate Institute of Precision Engineering, National Chung-Hsing University, Taiwan R.O.C. (2006)).

In addition, the LED tube lamp may be supplied with electrical power from two end caps respectively disposed at two ends of the glass lamp tube of the LED tube lamp and a user may be electrically shocked when he installs the LED tube lamp to a lamp holder and touches the metal parts or the electrically conductive parts which are still exposed.

Accordingly, the prevent disclosure and its embodiments are herein provided.

SUMMARY OF THE INVENTION

It's specially noted that the present disclosure may actually include one or more inventions claimed currently or not yet claimed, and for avoiding confusion due to unnecessarily distinguishing between those possible inventions at the stage of preparing the specification, the possible plurality of inventions herein may be collectively referred to as "the (present) invention" herein.

Various embodiments are summarized in this section, and are described with respect to the "present invention," which terminology is used to describe certain presently disclosed embodiments, whether claimed or not, and is not necessarily an exhaustive description of all possible embodiments, but rather is merely a summary of certain embodiments. Certain of the embodiments described below as various aspects of the "present invention" can be combined in different manners to form an LED tube lamp or a portion thereof.

The present invention provides a novel LED tube lamp, and aspects thereof.

The present invention provides an LED tube lamp. According to one embodiment, the LED lamp includes a glass lamp tube, an end cap, a power supply, and an LED light strip. The glass lamp tube is covered by a heat shrink sleeve. A thickness of the heat shrink sleeve is between 20 μm and 200 μm. At least a part of an inner surface of the glass lamp tube is formed with a rough surface and the roughness of the inner surface is higher than that of an outer surface of the glass lamp tube. The end cap is disposed at one end of the glass lamp tube. The power supply is provided inside the end cap. The LED light strip is disposed inside the glass lamp tube with a plurality of LED light sources mounted on the LED light strip. The LED light strip has a bendable circuit sheet which is made of a metal layer structure and mounted on the inner surface of the glass lamp tube to electrically connect the LED light sources with the power supply. The length of the bendable circuit sheet is larger than the length of the glass lamp tube. The glass lamp tube and the end cap are secured by a highly thermal conductive silicone gel.

In some embodiments, the thermal conductivity of the highly thermal conductive silicone gel may be not less than 0.7 w/m·k.

In some embodiments, the thickness of the metal layer structure may range from 10 μm to 50 μm.

In some embodiments, the metal layer structure may be a patterned wiring layer.

In some embodiments, the roughness of the inner surface may range from 0.1 to 40 μm.

In some embodiments, the glass lamp tube may be coated with an anti-reflection layer with a thickness of one quarter of the wavelength range of light coming from the LED light source.

In some embodiments, the refractive index of the anti-reflection layer may be a square root of the refractive index of the glass lamp tube with a tolerance of ±20%.

In some embodiments, the bendable circuit sheet may have its ends extending beyond two ends of the glass lamp tube to respectively form two freely extending end portions.

In some embodiments, the LED tube lamp further may include one or more reflective films to reflect light from the plurality of LED light sources.

In some embodiments, the glass lamp tube may further include a diffusion film so that the light emitted from the plurality of LED light sources is transmitted through the diffusion film and the glass lamp tube.

In some embodiments, the glass lamp tube may be covered with an adhesive film.

The present invention also provides an LED tube lamp, according to one embodiment, includes a glass lamp tube, an end cap, a power supply, and an LED light strip. At least a part of an inner surface of the glass lamp tube is formed with a rough surface and a roughness of the inner surface is higher than that of the outer surface. The end cap is disposed at one end of the glass lamp tube. The power supply is provided inside the end cap. The LED light strip is disposed inside the glass lamp tube with a plurality of LED light sources mounted on the LED light strip. The LED light strip has a bendable circuit sheet mounted on an inner surface of the glass lamp tube to electrically connect the LED light sources with the power supply. The length of the bendable circuit sheet is larger than the length of the glass lamp tube. The glass lamp tube and the end cap are secured by a highly thermal conductive silicone gel.

The present invention also provides an LED tube lamp, according to one embodiment, includes a glass lamp tube, an end cap, a power supply, and an LED light strip. The glass lamp tube is covered by a heat shrink sleeve. The inner surface of the glass lamp tube is formed with a rough surface, the roughness of the inner surface is higher than that of the outer surface, and the roughness of the inner surface ranges from 0.1 to 40 μm. The end cap is disposed at one end of the glass lamp tube. The power supply is provided inside the end cap. The LED light strip is disposed inside the glass lamp tube with a plurality of LED light sources mounted on the LED light strip. The LED light strip has a bendable circuit sheet which is made of a metal layer structure and mounted on an inner surface of the glass lamp tube to electrically connect the LED light sources with the power supply. The length of the bendable circuit sheet is larger than the length of the glass lamp tube. The glass lamp tube and the end cap are secured by a highly thermal conductive silicone gel.

The rough surface and the roughness of the inner surface of the glass lamp tube can make the light from the LED light sources be uniform when transmitting through the glass lamp tube.

The heat shrink sleeve is capable of making the glass lamp tube electrically insulated. The heat shrink sleeve may be substantially transparent with respect to the wavelength of light from the LED light sources, such that only a slight part of the lights transmitting through the glass lamp tube is absorbed by the heat shrink sleeve. If the thickness of the heat shrink sleeve is between 20 μm to 200 μm, the light absorbed by the heat shrink sleeve is negligible.

The highly thermal conductive silicone gel has excellent weatherability and can prevent moisture from entering inside of the glass lamp tube, which improves the durability and reliability of the LED tube lamp.

The anti-reflection layer is capable of reducing the reflection occurring at an interface between the glass lamp tube's inner surface and the air, which allows more light from the LED light sources transmit through the glass lamp tube.

DETAILED DESCRIPTION OF PREFERRED EMBODIMENTS

The present disclosure provides a novel LED tube lamp based on the glass made lamp tube to solve the abovementioned problems. The present disclosure will now be described in the following embodiments with reference to the drawings. The following descriptions of various embodiments of this invention are presented herein for purpose of illustration and giving examples only. It is not intended to be exhaustive or to be limited to the precise form disclosed. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

"Terms such as "about" or "approximately" may reflect sizes, orientations, or layouts that vary only in a small relative manner, and/or in a way that does not significantly alter the operation, functionality, or structure of certain elements. For example, a range from "about 0.1 to about 1" may encompass a range such as a 0% to 5% deviation around 0.1 and a 0% to 5% deviation around 1, especially if such deviation maintains the same effect as the listed range."

"Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein."

Figure 1A:
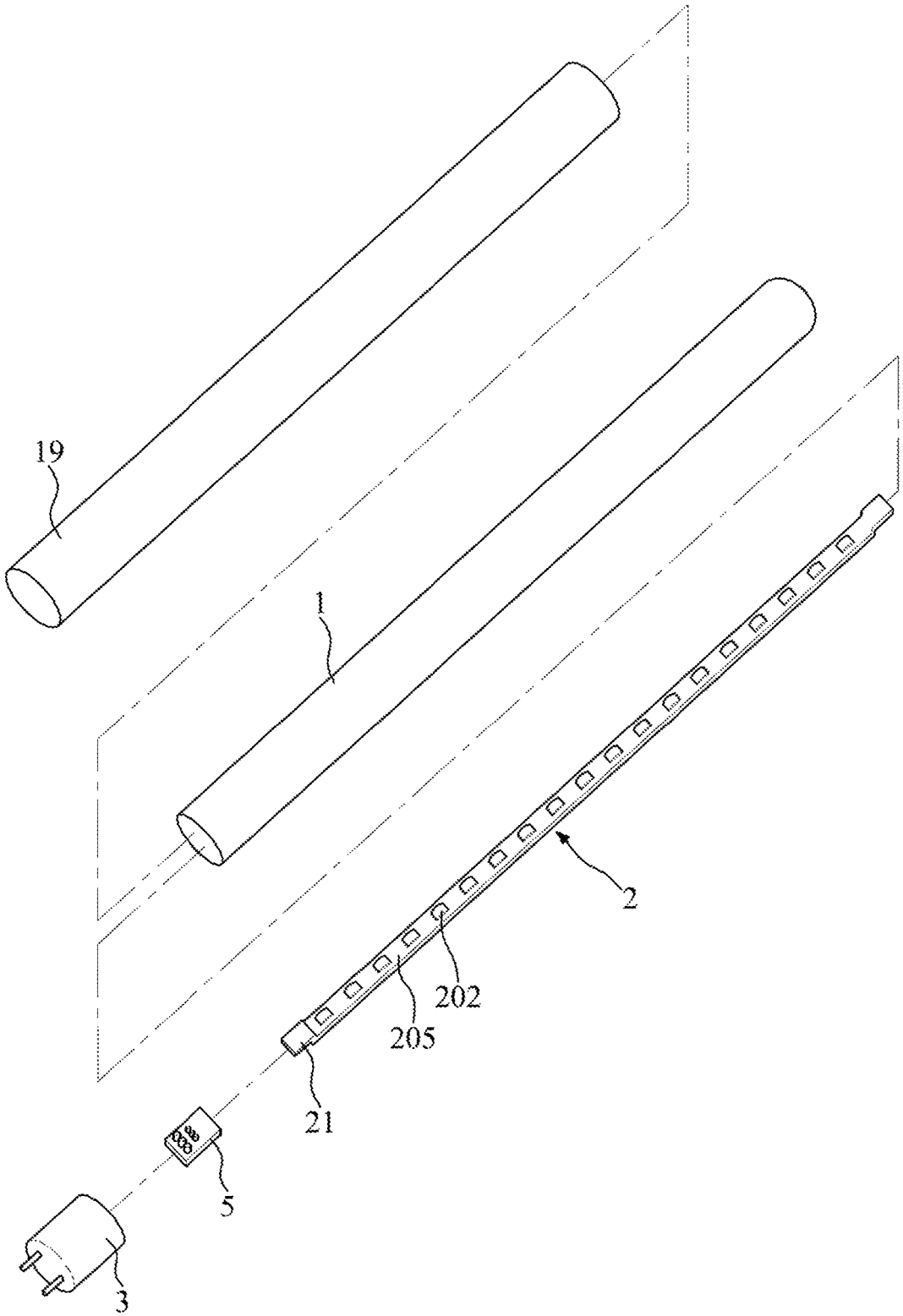
FIG. 1A is an exploded view schematically illustrating the LED tube lamp according to one embodiment of the present invention, wherein the glass lamp tube has only one inlets located at its one end while the other end is entirely sealed or integrally formed with tube body.
Figure 1B:
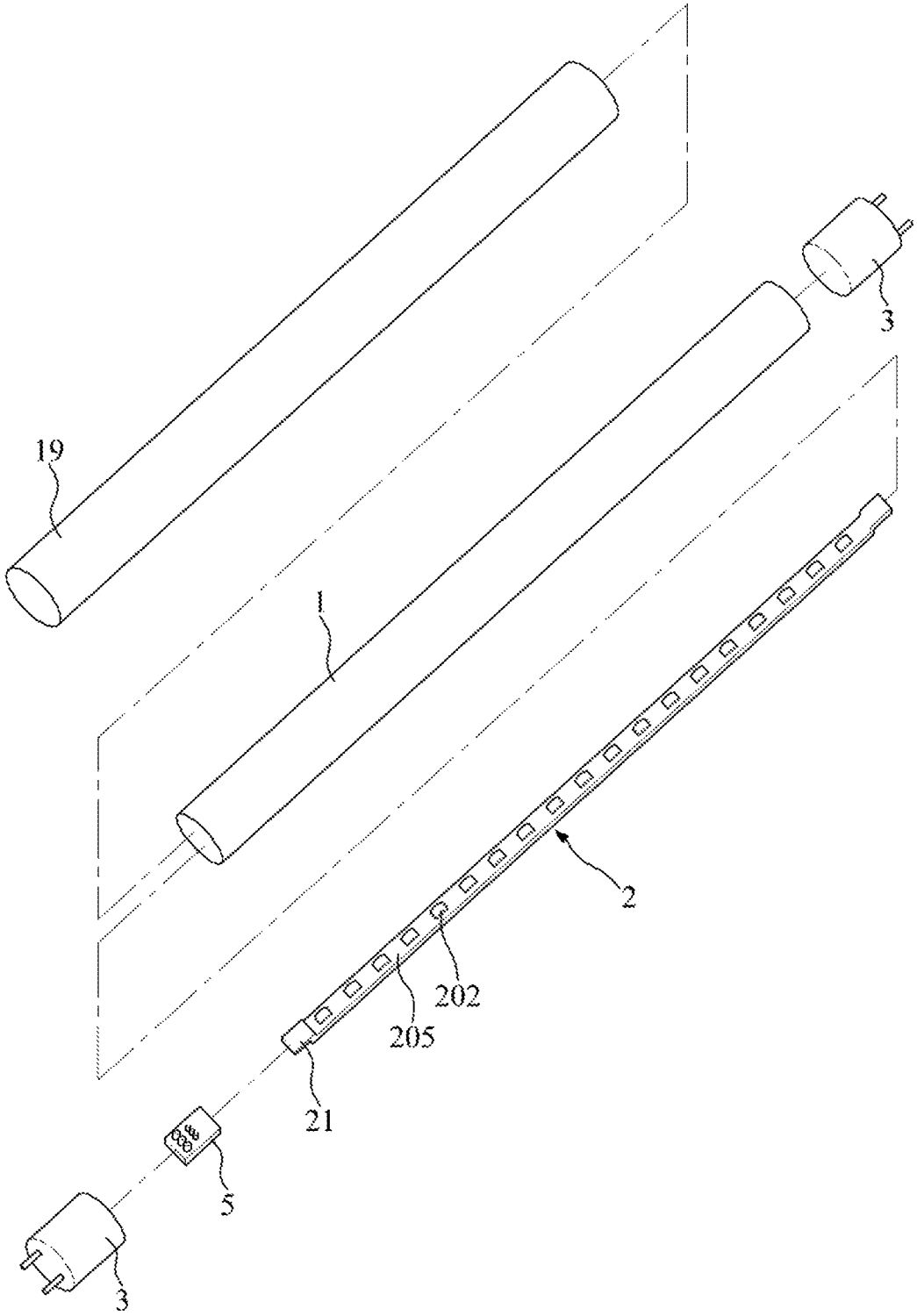
FIG. 1B is an exploded view schematically illustrating the LED tube lamp according to one embodiment of the present invention, wherein the glass lamp tube has two inlets respectively located at its two ends.
Figure 1C:
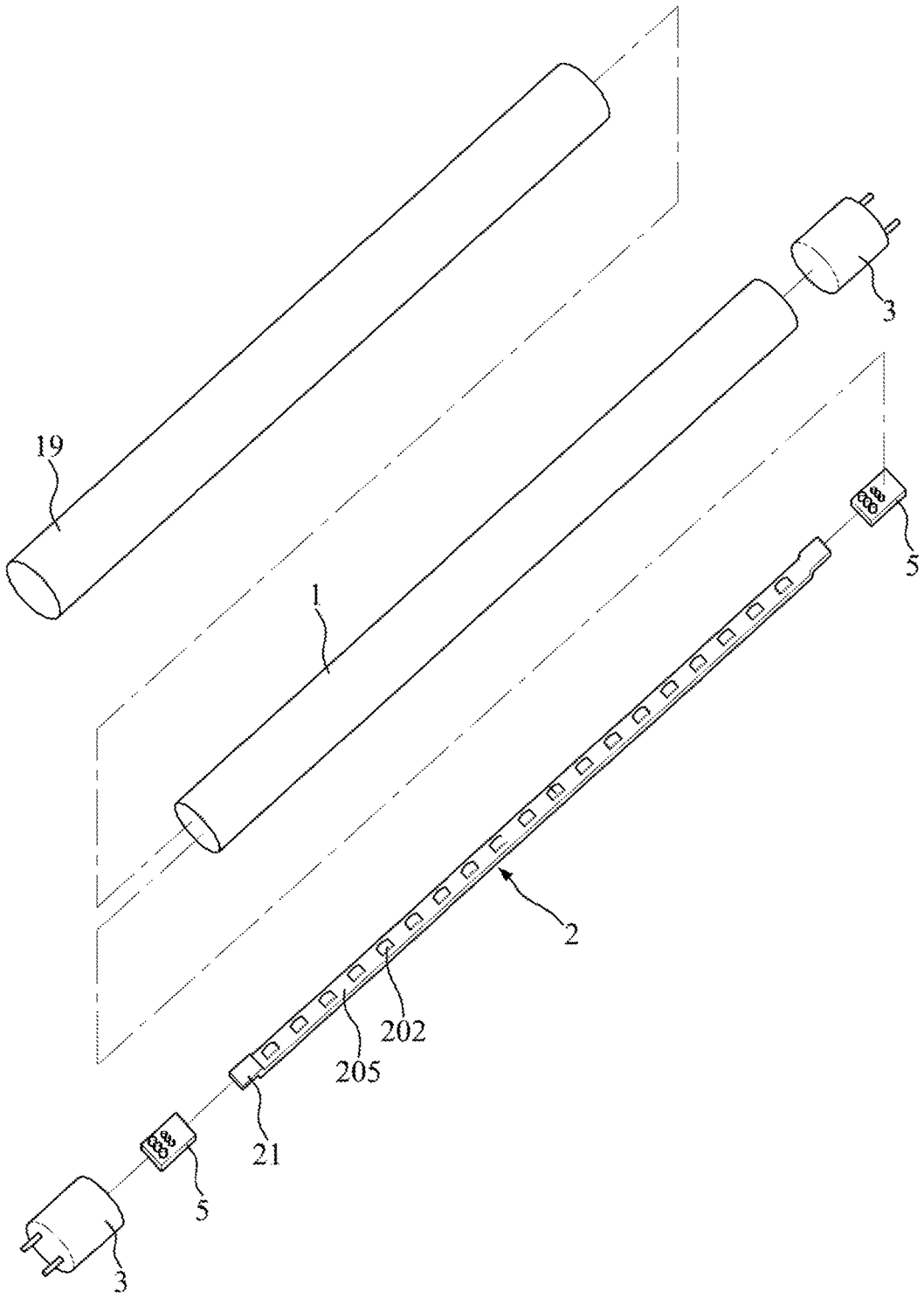
FIG. 1C is an exploded view schematically illustrating the LED tube lamp according to one embodiment of the present invention, wherein the glass lamp tube has two inlets respectively located at its two ends, and two power supplies are respectively disposed in two end caps.

Referring to FIG. 1A, FIG. 1B, and FIG. 1C, an LED tube lamp in accordance with a first embodiment of the present invention includes a glass lamp tube 1, an LED light strip 2 disposed inside the glass lamp tube 1, and one end cap 3 disposed at one end of the glass lamp tube 1. Each of the end caps 3 has at least one pin. As shown in FIG. 1A, FIG. 1B, and FIG. 1C, there are two pins on each end cap 3 to be connected with an outer electrical power source. In this embodiment, as shown in FIG. 1A, the glass lamp tube 1 may have only one inlet located at one end while the other end is entirely sealed or integrally formed with tube body. The LED light strip 2 is disposed inside the glass lamp tube 1 with a plurality of LED light sources 202 mounted on the LED light strip 2. The end cap 3 is disposed at the end of the glass lamp tube 1 where the inlet located, and the power supply 5 is provided inside the end cap 3. In another embodiment, as shown in FIG. 1B, the glass lamp tube 1 may have two inlets, two end caps 3 respectively disposed at two ends of the glass lamp tube 1, and one power supply 5 provided inside one of the end caps 3. In another embodiment, as shown in FIG. 1C, the glass lamp tube 1 may have two inlets, two end caps 3 respectively disposed at two ends of the glass lamp tube 1, and two power supplies 5 respectively provided inside the two end caps 3.

The glass lamp tube 1 is covered by a heat shrink sleeve 19. The thickness of the heat shrink sleeve 19 may range from 20 μm to 200 μm. The heat shrink sleeve 19 is substantially transparent with respect to the wavelength of light from the LED light sources 202 such that only a slight part of the lights transmitting through the glass lamp tube is absorbed by the heat shrink sleeve 19. The heat shrink sleeve 19 may be made of PFA (perfluoroalkoxy) or PTFE (poly tetra fluoro ethylene). Since the thickness of the heat shrink sleeve 19 is only 20 μm to 200 μm, the light absorbed by the heat shrink sleeve 19 is negligible. At least a part of the inner surface of the glass lamp tube 1 is formed with a rough surface and the roughness of the inner surface is higher than that of the outer surface, such that the light from the LED light sources 202 can be uniformly spread when transmitting through the glass lamp tube 1. In some embodiments, the roughness of the inner surface of the glass lamp tube 1 may range from 0.1 μm to 40 μm.

The glass lamp tube 1 and the end cap 3 are secured by a highly thermal conductive silicone gel disposed between an inner surface of the end cap 3 and outer surfaces of the glass lamp tube 1. In some embodiments, the highly thermal conductive silicone gel has a thermal conductivity not less than 0.7 w/m·k. In some embodiments, the thermal conductivity of the highly thermal conductive silicone gel is not less than 2 w/m·k. In some embodiments, the highly thermal conducive silicone gel is of high viscosity, and the end cap 3 and the end of the glass lamp tube 1 could be secured by using the highly thermal conductive silicone gel and therefore qualified in a torque test of 1.5 to 5 newton-meters (Nt-m) and/or in a bending test of 5 to 10 newton-meters (Nt-m). The highly thermal conductive silicone gel has excellent weatherability and can prevent moisture from entering inside of the glass lamp tube 1, which improves the durability and reliability of the LED tube lamp.

Referring to FIG. 1A, FIG. 1B, FIG. 1C, and FIG. 2, the LED light strip 2 has a bendable circuit sheet 205 mounted on the inner surface of the glass lamp tube 1.

Figure 2:
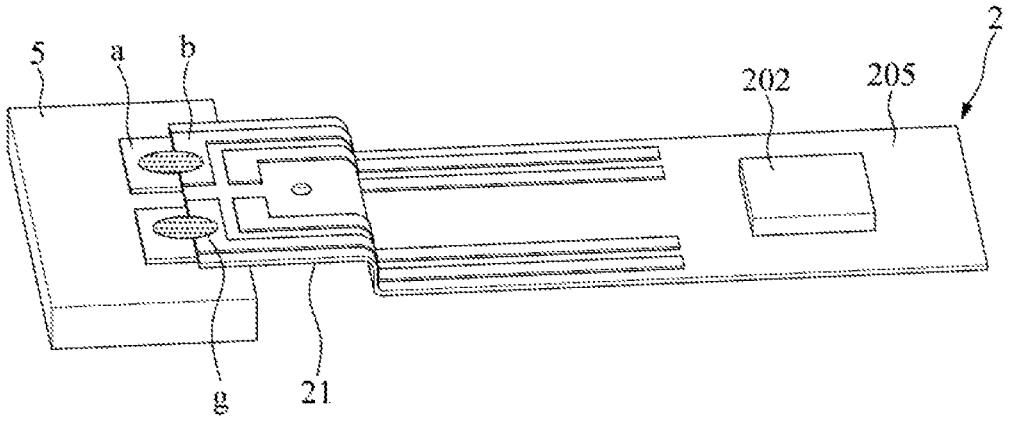
FIG. 2 is a perspective view schematically illustrating the soldering pad of the bendable circuit sheet of the LED light strip for soldering connection with the printed circuit board of the power supply of the LED tube lamp according to one embodiment of the present invention.

The bendable circuit sheet 205 electrically connects the LED light sources 202 with the power supply 5, and the length of the bendable circuit sheet 205 is larger than the length of the glass lamp tube 1. The bendable circuit sheet 205 has its ends extending beyond two ends of the glass lamp tube 1 to respectively form two freely extending end portions 21. As shown in FIG. 2, in which only one freely extending end portion 21 is illustrated, the freely extending end portion 21 is electrically connected to the power supply 5. Specifically, the power supply 5 has soldering pads "a" which are capable of being soldered with the soldering pads "b" of the freely extending end portion 21 by soldering material "g".

Figure 3:
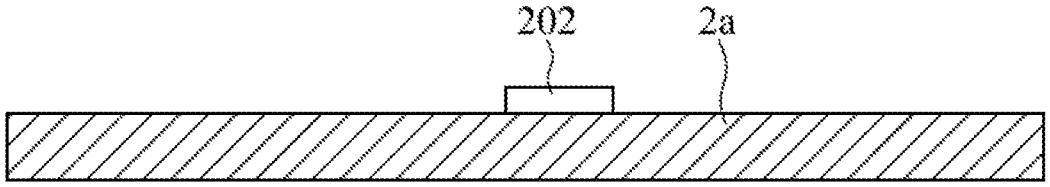
FIG. 3 is a plane cross-sectional view schematically illustrating a single-layered structure of the bendable circuit sheet of the LED light strip of the LED tube lamp according to an embodiment of the present invention.

Referring to FIG. 3, the bendable circuit sheet 205 is made of a metal layer structure 2*a*. The thickness range of the metal layer structure 2*a* ma be 10 μm to 50 μm and the metal layer structure 2*a* may be a patterned wiring layer.

In some embodiments, the inner surface of the glass lamp tube 1 is coated with an anti-reflection layer with a thickness of one quarter of the wavelength range of light coming from the LED light sources 202. With the anti-reflection layer, more light from the LED light sources 202 can transmit through the glass lamp tube 1. In some embodiments, the refractive index of the anti-reflection layer is a square root of the refractive index of the glass lamp tube 1 with a tolerance of ±20%.

Figure 4:
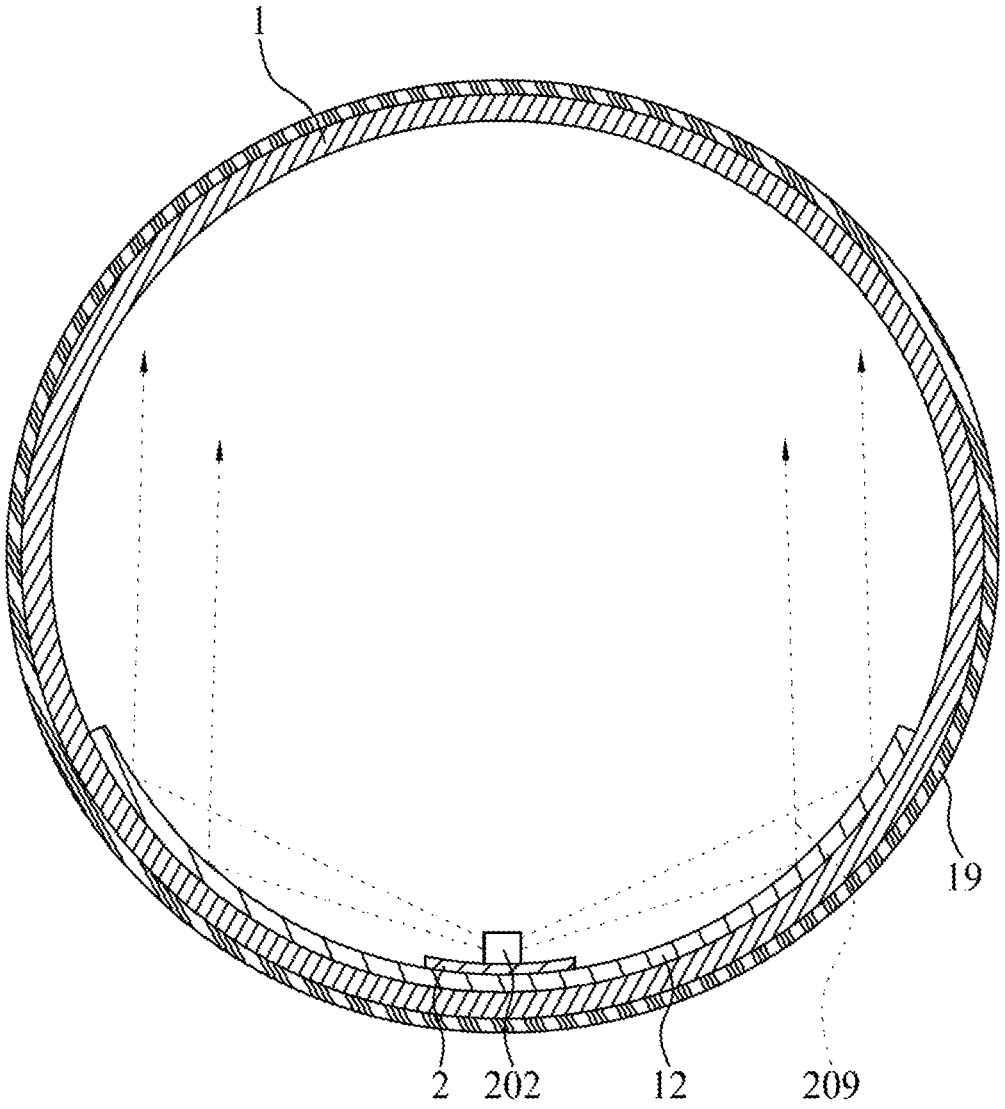
FIG. 4 is a plane cross-sectional view schematically illustrating inside structure of the glass lamp tube of the LED tube lamp according to one embodiment of the present invention, wherein two reflective films are respectively adjacent to two sides of the LED light strip along the circumferential direction of the glass lamp tube.

Referring to FIG. 4, in some embodiments, the glass lamp tube 1 may further include one or more reflective films 12 disposed on the inner surface of the glass lamp tube 1. The reflective film 12 can be positioned on two sides of the LED light strip 2. And in some embodiments, a ratio of a length of the reflective film 12 disposed on the inner surface of the glass lamp tube 1 extending along the circumferential direction of the glass lamp tube 1 to a circumferential length of the glass lamp tube 1 may be about 0.3 to 0.5, which means about 30% to 50% of the inner surface area may be covered by the reflective film(s) 12. The reflective film 12 may be made of PET with some reflective materials such as strontium phosphate or barium sulfate or any combination thereof, with a thickness between about 140 μm and about 350 μm or between about 150 μm and about 220 μm for a more preferred effect in some embodiments. In some embodiments, only the part of the inner surface which is not covered by the reflective film 12 is formed with the rough surface. As shown in FIG. 4, a part of light 209 from LED light sources 202 are reflected by two reflective films 12 such that the light 209 from the LED light sources 202 can be centralized to a determined direction.

Figure 5:
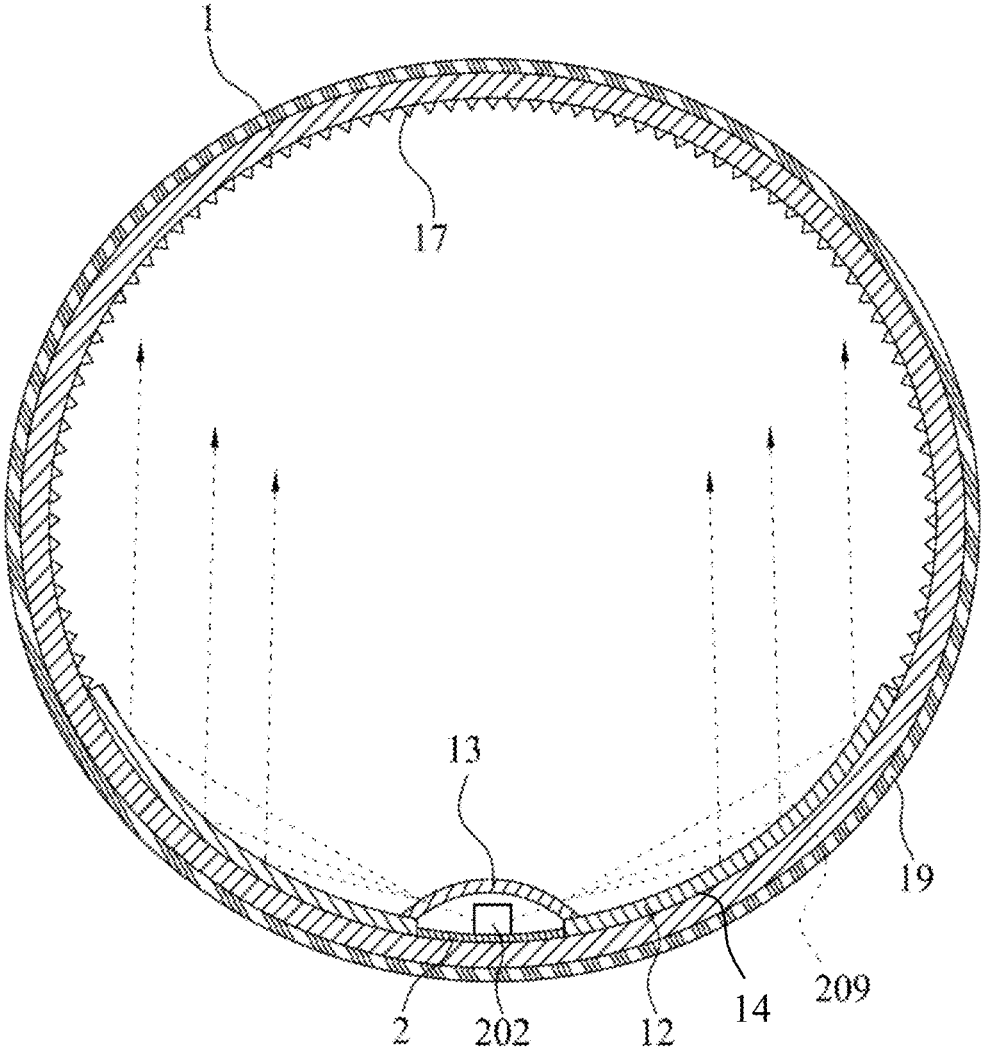
FIG. 5 is a plane cross-sectional view schematically illustrating inside structure of the glass lamp tube of the LED tube lamp according to one embodiment of the present invention, wherein two reflective films are respectively adjacent to two sides of the LED light strip along the circumferential direction of the glass lamp tube and a diffusion film is disposed covering the LED light sources.
Figure 6:
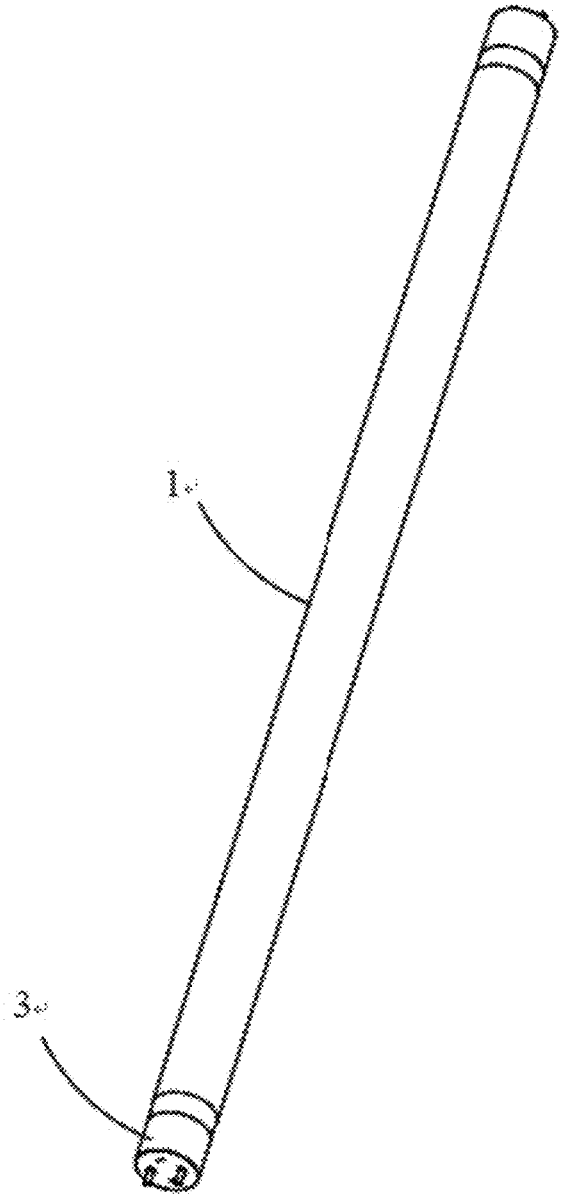
FIG. 6 is a three dimensional schematic view of an LED tube lamp according to an embodiment of the invention.

Referring to FIG. 5, in some embodiments, the glass lamp tube 1 may further include a diffusion film 13 so that the light emitted from the plurality of LED light sources 202 is transmitted through the diffusion film 13 and the glass lamp tube 1. The diffusion film 13 can be in form of various types, such as a coating onto the inner wall or outer wall of the glass lamp tube 1, or a diffusion coating layer (not shown) coated at the surface of each LED light sources 202, or a separate membrane covering the LED light sources 202. The glass lamp tube 1 also includes a heat shrink sleeve 19 and a plurality of inner roughness 17.

As shown in FIG. 5, the diffusion film 13 is in form of a sheet, and it covers but not in contact with the LED light sources 202. In some embodiments, the diffusion film 13 can be disposed on the inner surface or the outer surface of the lamp tube. The diffusion film 13 in form of a sheet is usually called an optical diffusion sheet or board, usually a composite made of mixing diffusion particles into polystyrene (PS), polymethyl methacrylate (PMMA), polyethylene terephthalate (PET), and/or polycarbonate (PC), and/or any combination thereof. The light passing through such composite is diffused to expand in a wide range of space such as a light emitted from a plane source, and therefore makes the brightness of the LED tube lamp uniform.

The diffusion film 13 may be in form of an optical diffusion coating, which is composed of any one of calcium carbonate, halogen calcium phosphate and aluminum oxide, or any combination thereof. When the optical diffusion coating is made from a calcium carbonate with suitable solution, an excellent light diffusion effect and transmittance to exceed 90% can be obtained.

In some embodiments, the composition of the diffusion film 13 in form of the optical diffusion coating may include calcium carbonate, strontium phosphate, thickener, and a ceramic activated carbon. Specifically, such an optical diffusion coating on the inner circumferential surface of the glass lamp tube 1 has an average thickness ranging from about 20 to about 30 μm. A light transmittance of the diffusion film 13 using this optical diffusion coating may be about 90%. Generally speaking, the light transmittance of the diffusion film 13 may range from 85% to 96%. In addition, this diffusion film 13 can also provide electrical isolation for reducing risk of electric shock to a user upon breakage of the glass lamp tube 1. Furthermore, the diffusion film 13 provides an improved illumination distribution uniformity of the light outputted by the LED light sources 202 such that the light can illuminate the back of the light sources 202 and the side edges of the bendable circuit sheet 205 so as to avoid the formation of dark regions inside the glass lamp tube 1 and improve the illumination comfort. In another possible embodiment, the light transmittance of the diffusion film can be 92% to 94% while the thickness ranges from about 200 to about 300 μm.

In another embodiment, the optical diffusion coating can also be made of a mixture including calcium carbonate-based substance, some reflective substances like strontium phosphate or barium sulfate, a thickening agent, ceramic activated carbon, and deionized water. The mixture is coated on the inner circumferential surface of the glass lamp tube 1 and may have an average thickness ranging from about 20 to about 30 μm. In view of the diffusion phenomena in microscopic terms, light is reflected by particles. The particle size of the reflective substance such as strontium phosphate or barium sulfate will be much larger than the particle size of the calcium carbonate. Therefore, adding a small amount of reflective substance in the optical diffusion coating can effectively increase the diffusion effect of light.

Halogen calcium phosphate or aluminum oxide can also serve as the main material for forming the diffusion film 13. The particle size of the calcium carbonate may be about 2 to 4 μm, while the particle size of the halogen calcium phosphate and aluminum oxide may be about 4 to 6 μm and 1 to 2 μm, respectively. When the light transmittance is required to be 85% to 92%, the required average thickness for the optical diffusion coating mainly having the calcium carbonate may be about 20 to about 30 μm, while the required average thickness for the optical diffusion coating mainly having the halogen calcium phosphate may be about 25 to about 35 μm, the required average thickness for the optical diffusion coating mainly having the aluminum oxide may be about 10 to about 15 μm. However, when the required light transmittance is up to 92% and even higher, the optical diffusion coating mainly having the calcium carbonate, the halogen calcium phosphate, or the aluminum oxide must be thinner.

The main material and the corresponding thickness of the optical diffusion coating can be decided according to the place for which the glass lamp tube 1 is used and the light transmittance required. It is to be noted that the higher the light transmittance of the diffusion film 13 is required, the more apparent the grainy visual of the light sources is.

In some embodiments the inner peripheral surface or the outer circumferential surface of the glass lamp tube 1 may be further covered or coated with an adhesive film (not shown) to isolate the inside from the outside of the glass lamp tube 1. In this embodiment, the adhesive film is coated on the inner peripheral surface of the glass lamp tube 1. The configuration of the adhesive film may be represented by the circular line indicated by the reference number 14 in FIG. 5, which shows that the adhesive film may be formed on the inner peripheral surface of the glass lamp tube 1 and contained between the diffusion film 13 and the lamp tube 1. The material for the coated adhesive film includes methyl vinyl silicone oil, hydro silicone oil, xylene, and calcium carbonate, wherein xylene is used as an auxiliary material. The xylene will be volatilized and removed when the coated adhesive film on the inner surface of the glass lamp tube 1 solidifies or hardens. The xylene is mainly used to adjust the capability of adhesion and therefore to control the thickness of the coated adhesive film.

In some embodiments, the thickness of the coated adhesive film may be between about 100 and about 140 micrometers (μm). The adhesive film having a thickness being less than 100 micrometers may not have sufficient shatterproof capability for the glass lamp tube 1, and the glass lamp tube 1 is thus prone to crack or shatter. The adhesive film having a thickness being larger than 140 micrometers may reduce the light transmittance and also increases material cost. The thickness of the coated adhesive film may be between about 10 and about 800 micrometers (μm) when the shatterproof capability and the light transmittance are not strictly demanded.

In some embodiments, the LED tube lamp according to the embodiment of present invention can include an optical adhesive sheet. Various kinds of the optical adhesive sheet can be combined to constitute various embodiments of the present invention. The optical adhesive sheet, which is a clear or transparent material, is applied or coated on the surface of the LED light source 202 in order to ensure optimal light transmittance. After being applied to the LED light sources 202, the optical adhesive sheet may have a granular, strip-like or sheet-like shape. The performance of the optical adhesive sheet depends on its refractive index and thickness. The refractive index of the optical adhesive sheet is in some embodiments between 1.22 and 1.6. In some embodiments, it is better for the optical adhesive sheet to have a refractive index being a square root of the refractive index of the housing or casing of the LED light source 202, or the square root of the refractive index of the housing or casing of the LED light source 202 plus or minus 15%, to contribute better light transmittance. The housing/casing of the LED light sources 202 is a structure to accommodate and carry the LED dies (or chips) such as a LED lead frame. The refractive index of the optical adhesive sheet may range from 1.225 to 1.253. In some embodiments, the thickness of the optical adhesive sheet may range from 1.1 mm to 1.3 mm. The optical adhesive sheet having a thickness less than 1.1 mm may not be able to cover the LED light sources 202, while the optical adhesive sheet having a thickness more than 1.3 mm may reduce light transmittance and increases material cost.

In process of assembling the LED light sources to the LED light strip 2, the optical adhesive sheet is firstly applied on the LED light sources 202; then an insulation adhesive sheet is coated on one side of the LED light strip 2; then the LED light sources 202 are fixed or mounted on the LED light strip 2; the other side of the LED light strip 2 being opposite to the side of mounting the LED light sources 202 is bonded and affixed to the inner surface of the lamp tube 1 by an adhesive sheet; finally, the end cap 3 is fixed to the end portion of the lamp tube 1, and the LED light sources 202 and the power supply 5 are electrically connected by the LED light strip 2.

In one embodiment, each of the LED light sources 202 may be provided with a LED lead frame having a recess, and an LED chip disposed in the recess. The recess may be one or more than one in amount. The recess may be filled with phosphor covering the LED chip to convert emitted light therefrom into a desired light color. Compared with a conventional LED chip being a substantial square, the LED chip in this embodiment is in some embodiments rectangular with the dimension of the length side to the width side at a ratio ranges generally from about 2:1 to about 10:1, in some embodiments from about 2.5:1 to about 5:1, and in some more desirable embodiments from 3:1 to 4.5:1. Moreover, the LED chip is in some embodiments arranged with its length direction extending along the length direction of the glass lamp tube 1 to increase the average current density of the LED chip and improve the overall illumination field shape of the glass lamp tube 1. The glass lamp tube 1 may have a number of LED light sources 202 arranged into one or more rows, and each row of the LED light sources 202 is arranged along the length direction (Y-direction) of the glass lamp tube 1.

Referring to FIG. 1A, FIG. 1B, and FIG. 1C, an LED tube lamp in accordance with a second embodiment of the present invention includes a glass lamp tube 1, an LED light strip 2, and one end cap 3 disposed at one end of the glass lamp tube 1. At least a part of the inner surface of the glass lamp tube 1 is formed with a rough surface and the roughness of the inner surface is higher than that of the outer surface. In this embodiment, the glass lamp tube 1 may have only one inlet located at one end while the other end is entirely sealed or integrally formed with tube body. The LED light strip 2 is disposed inside the glass lamp tube 1 with a plurality of LED light sources 202 mounted on the LED light strip 2. The end cap 3 is disposed at the end of the glass lamp tube 1 where the inlet located, and the power supply 5 is provided inside the end cap 3. In another embodiment, as shown in FIG. 1B, the glass lamp tube 1 may have two inlets, two end caps 3 respectively disposed at two ends of the glass lamp tube 1, and one power supply 5 provided inside one of the end caps 3. In another embodiment, as shown in FIG. 1C, the glass lamp tube 1 may have two inlets, two end caps 3 respectively disposed at two ends of the glass lamp tube 1, and two power supplies 5 respectively provided inside the two end caps 3.

The glass lamp tube 1 is covered by a heat shrink sleeve 19. The heat shrink sleeve 19 is substantially transparent with respect to the wavelength of light from the LED light sources 202 and may be made of PFA (perfluoroalkoxy) or PTFE (poly tetra fluoro ethylene). At least a part of the inner surface of the glass lamp tube 1 is formed with a rough surface and the roughness of the inner surface is higher than that of the outer surface, such that the light from the LED light sources 202 can be uniformly spread when transmitting through the glass lamp tube 1.

The glass lamp tube 1 and the end cap 3 are secured by a highly thermal conductive silicone gel disposed between an inner surface of the end cap 3 and outer surfaces of the glass lamp tube 1. In some embodiments, the highly thermal conductive silicone gel has a thermal conductivity not less than 0.7 w/m·k. In some embodiments, the thermal conductivity of the highly thermal conductive silicone gel is not less than 2 w/m·k. In some embodiments, the highly thermal conducive silicone gel is of high viscosity, and the end cap 3 and the end of the glass lamp tube 1 could be secured by using the highly thermal conductive silicone gel and therefore qualified in a torque test of 1.5 to 5 newton-meters (Nt-m) and/or in a bending test of 5 to 10 newton-meters (Nt-m). The highly thermal conductive silicone gel has excellent weatherability and can prevent moisture from entering inside of the glass lamp tube 1, which improves the durability and reliability of the LED tube lamp.

Referring to FIG. 1A, FIG. 1B, FIG. 1C, and FIG. 2, the LED light strip 2 has a bendable circuit sheet 205 mounted on the inner surface of the glass lamp tube 1. The bendable circuit sheet 205 electrically connects the LED light sources 202 with the power supply 5, and the length of the bendable circuit sheet 205 is larger than the length of the glass lamp tube 1. In some embodiments, the bendable circuit sheet 205 has its ends extending beyond two ends of the glass lamp tube 1 to respectively form two freely extending end portions 21. As shown in FIG. 2, in which only one freely extending end portion 21 is illustrated, the freely extending end portion 21 is electrically connected to the power supply 5. Specifically, the power supply 5 has soldering pads "a" which are capable of being soldered with the soldering pads "b" of the freely extending end portion 21 by soldering material "g".

In the previously-described first embodiment, the bendable circuit sheet 205 is made of a metal layer structure 2*a*, and the thickness of the heat shrink sleeve 19 is between 20 μm and 200 μm. However, in the second embodiment, the structure of the bendable circuit sheet 205 and the thickness of the heat shrink sleeve 19 are not limited.

In the second embodiment, the inner surface of the glass lamp tube 1 may be coated with an anti-reflection layer with a thickness of one quarter of the wavelength range of light coming from the LED light sources 202. The configuration of the anti-reflection layer may be represented by the circular line indicated by the reference number 14 in FIG. 5, which shows that the anti-reflection layer may be coated on the inner surface of the glass lamp tube 1. With the anti-reflection layer, more light from the LED light sources 202 can transmit through the glass lamp tube 1.

Referring to FIG. 4, in the second embodiment, the glass lamp tube 1 may further include one or more reflective films 12 disposed on the inner surface of the glass lamp tube 1. In some embodiments, only the part of the inner surface which is not covered by the reflective film 12 is formed with the rough surface. As shown in FIG. 4, a part of light 209 from LED light sources 202 are reflected by two reflective films 12 such that the light 209 from the LED light sources 202 can be centralized to a determined direction.

Referring to FIG. 5, in the second embodiment, the glass lamp tube 1 may further include a diffusion film 13 so that the light emitted from the plurality of LED light sources 202 is transmitted through the diffusion film 13 and the glass lamp tube 1. The diffusion film 13 can be in form of various types as described in the first embodiment. The glass lamp tube 1 also includes a heat shrink sleeve 19 and a plurality of inner roughness 17.

In the second embodiment, the inner peripheral surface or the outer circumferential surface of the glass lamp tube 1 may be further covered or coated with an adhesive film (not shown) to isolate the inside from the outside of the glass lamp tube 1. The adhesive film may be coated on the inner peripheral surface of the glass lamp tube 1.

Referring to FIG. 1A, FIG. 1B, and FIG. 1C, an LED tube lamp in accordance with a third embodiment of the present invention includes a glass lamp tube 1, an LED light strip 2 disposed inside the glass lamp tube 1, and one end cap 3 disposed at one end of the glass lamp tube 1. In this embodiment, as shown in FIG. 1A, the glass lamp tube 1 may have only one inlet located at one end while the other end is entirely sealed or integrally formed with tube body. The LED light strip 2 is disposed inside the glass lamp tube 1 with a plurality of LED light sources 202 mounted on the LED light strip 2. The end cap 3 is disposed at the end of the glass lamp tube 1 where the inlet located, and the power supply 5 is provided inside the end cap 3. In another embodiment, as shown in FIG. 1B, the glass lamp tube 1 may have two inlets, two end caps 3 respectively disposed at two ends of the glass lamp tube 1, and one power supply 5 provided inside one of the end caps 3. In another embodiment, as shown in FIG. 1C, the glass lamp tube 1 may have two inlets, two end caps 3 respectively disposed at two ends of the glass lamp tube 1, and two power supplies 5 respectively provided inside the two end caps 3.

The glass lamp tube 1 is covered by a heat shrink sleeve 19. The heat shrink sleeve 19 is substantially transparent with respect to the wavelength of light from the LED light sources 202 and may be made of PFA (perfluoroalkoxy) or PTFE (poly tetra fluoro ethylene). At least a part of the inner surface of the glass lamp tube 1 is formed with a rough surface with a roughness from 0.1 μm to 40 μm. The roughness of the inner surface is higher than that of the outer surface, such that the light from the LED light sources 202 can be uniformly spread when transmitting through the glass lamp tube 1.

The end cap 3 is disposed at one end of the glass lamp tube 1 and the power supply 5 is provided inside the end cap 3. The glass lamp tube 1 and the end cap 3 are secured by a highly thermal conductive silicone gel disposed between an inner surface of the end cap 3 and outer surfaces of the glass lamp tube 1. In some embodiments, the highly thermal conductive silicone gel has a thermal conductivity not less than 0.7 w/m·k. In some embodiments, the thermal conductivity of the highly thermal conductive silicone gel is not less than 2 w/m·k. In some embodiments, the highly thermal conducive silicone gel is of high viscosity, and the end cap 3 and the end of the glass lamp tube 1 could be secured by using the highly thermal conductive silicone gel and therefore qualified in a torque test of 1.5 to 5 newton-meters (Nt-m) and/or in a bending test of 5 to 10 newton-meters (Nt-m). The highly thermal conductive silicone gel has excellent weatherability and can prevent moisture from entering inside of the glass lamp tube 1, which improves the durability and reliability of the LED tube lamp.

Referring to FIG. 1A, FIG. 1B, FIG. 1C and FIG. 2, the LED light strip 2 has a bendable circuit sheet 205 mounted on the inner surface of the glass lamp tube 1. The bendable circuit sheet 205 electrically connects the LED light sources 202 with the power supply 5, and the length of the bendable circuit sheet 205 is larger than the length of the glass lamp tube 1. The bendable circuit sheet 205 has its ends extending beyond two ends of the glass lamp tube 1 to respectively form two freely extending end portions 21. As shown in FIG. 2, in which only one freely extending end portion 21 is illustrated, the freely extending end portion 21 is electrically connected to the power supply 5. Specifically, the power supply 5 has soldering pads "a" which are capable of being soldered with the soldering pads "b" of the freely extending end portion 21 by soldering material "g".

Referring to FIG. 3, in the third embodiment, the bendable circuit sheet 205 is made of a metal layer structure 2*a*. The thickness range of the metal layer structure 2*a* may be 10 μm to 50 μm and the metal layer structure 2*a* may be a patterned wiring layer.

In the third embodiment, the inner surface of the glass lamp tube 1 is coated with an anti-reflection layer with a thickness of one quarter of the wavelength range of light coming from the LED light sources 202. With the anti-reflection layer, more light from the LED light sources 202 can transmit through the glass lamp tube 1.

Referring to FIG. 4, in the third embodiment, the glass lamp tube 1 may further include one or more reflective films 12 disposed on the inner surface of the glass lamp tube 1. In some embodiments, only the part of the inner surface which is not covered by the reflective film 12 is formed with the rough surface. As shown in FIG. 4, a part of light 209 from LED light sources 202 are reflected by two reflective films 12 such that the light 209 from the LED light sources 202 can be centralized to a determined direction.

Referring to FIG. 5, in the third embodiment, the glass lamp tube 1 may further include a diffusion film 13 so that the light emitted from the plurality of LED light sources 202 is transmitted through the diffusion film 13 and the glass lamp tube 1. The diffusion film 13 can be in form of various types as described in the first embodiment. The glass lamp tube 1 also includes a heat shrink sleeve 19 and a plurality of inner roughness 17. As shown in FIG. 5, the reflective film 12 further comprises an opening (where the reflective film 12 is divided into a left part and a right part in a cross-sectional view shown in FIG. 5). The LED light strip 2 is disposed in the opening. The diffusion film 13 covers the opening of the reflective film 12.

In the third embodiment, the inner peripheral surface or the outer circumferential surface of the glass lamp tube 1 may be further covered or coated with an adhesive film (not shown) to isolate the inside from the outside of the glass lamp tube 1. The adhesive film may be coated on the inner peripheral surface of the glass lamp tube 1.

An embodiment of the invention provides an LED tube lamp, referring to FIG. 6 to FIG. 10, which comprises a housing 1, an LED light strip 2, a light strip insulation gel 7, a light source gel 8, end caps 3, a hot melt adhesive 6, an LED power 5, and an adhesive 4. The LED light strip 2 is fixed on an internal wall of the housing 1 by the adhesive 4. The LED light strip 2 is provided with a female plug 201 and comprises LED light sources 202. The end cap 3 is provided with hollow conductive pins 301. An end of the LED power 5 is provided with a male plug 501, and another end is provided with a metal pin 502. The male plug 501 on the end of the LED power 5 is plugged into the female plug 201 of the LED light strip 2. The metal pin 502 on the other end is plugged into the hollow conductive pin 301. As such, an electrical connection is performed. The light strip insulation gel 7 is applied on the LED light strip 2. The light source gel 8 is applied on the surface of the LED light source 202. As such, the entire LED light strip 2 is insulated. Incident of electrical shock can be avoided even the housing 1 is partially broken. The end cap 3 is fixed on ends of the housing by the hot melt adhesive 6. As such, an LED tube lamp is assembled.

Figure 7:
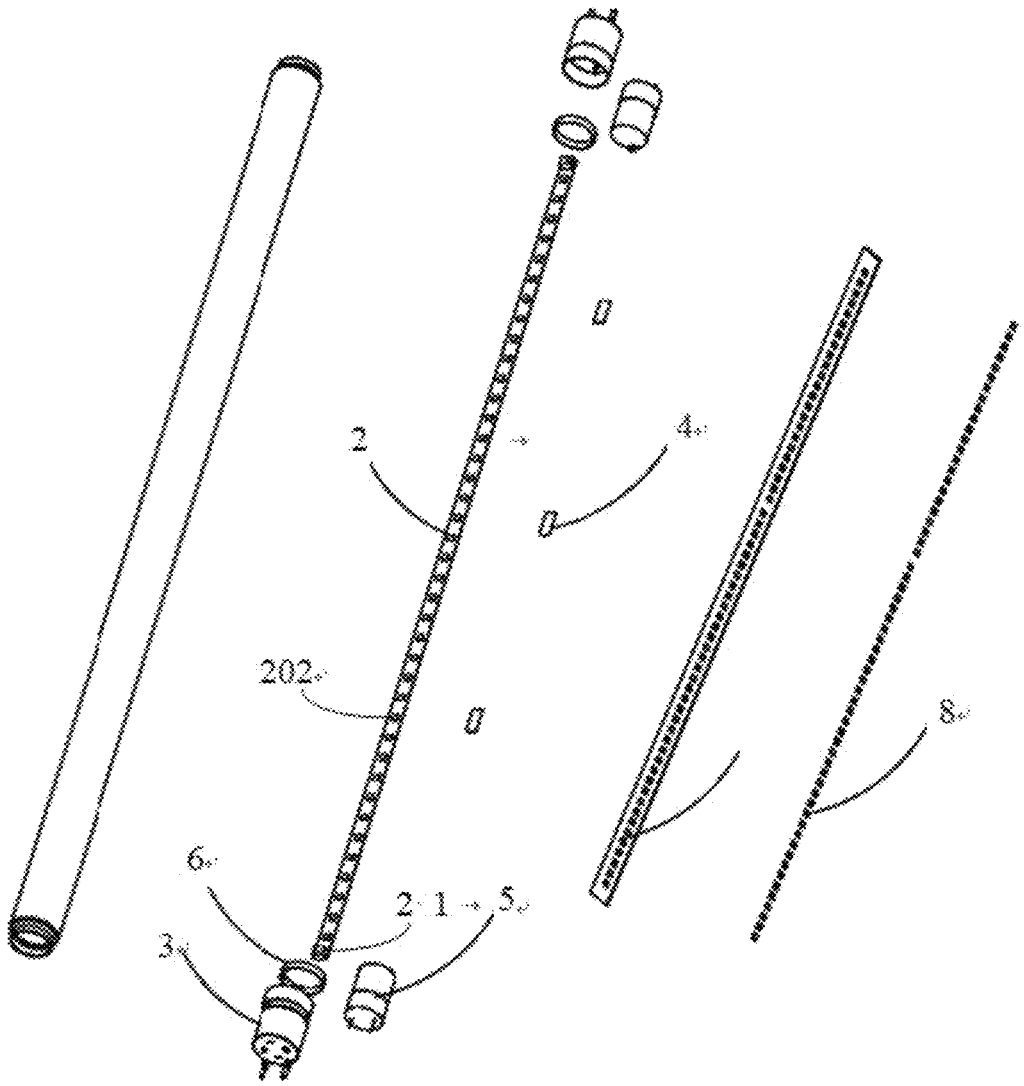
FIG. 7 is an exploded view of an LED tube lamp according to an embodiment of the invention.

The LED light strip 2 is fixed on an internal wall of the housing 1 by the adhesive 4. As shown in FIG. 7, the adhesive 4 shown in the figure is divided into three sections. It is noted that the number or the shape of the adhesive 4 is not limited. The adhesive 4 may be silicone gel or silicone gel sheet of a strip shape.

The LED light strip 2 is provided with the female plug 201. The end cap 3 is provided with hollow conductive pins 301. The metal pin 502 on the LED power 5 is plugged into the hollow conductive pin 301 on the end cap 3. The male plug 501 is plugged into the female plug 201 of the LED light strip 2 to be electrical connection. Current passing through the hollow conductive pin 301 of the end cap 3 is transmitted to the metal pin 502 of the power 5. After being transformed by the power 5, the current is outputted by the male plug 501 and is transmitted to the LED light strip 2 through the female plug 201 of the LED light strip 2. As such, the LED light sources 202 on the LED light strip 2 can be turned on. The fabrication is simple, which is benefit to be automatic.

Figure 8:
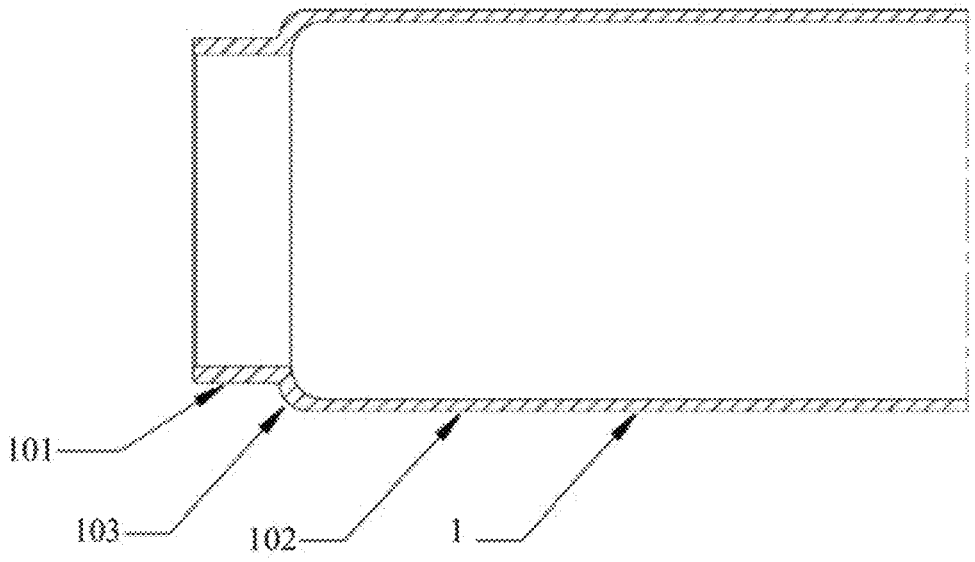
FIG. 8 is a cross sectional schematic view of a housing of an LED tube lamp according to an embodiment of the invention.

In addition, please refer to the cross sectional schematic view of the housing of FIG. 8. Taking the standard specification for T8 lamp as an example, 101 is the portion in the rear of the shrunk opening. The outer diameter is between 20.9 mm to 23 mm. If the outer diameter being less than 20.9 mm would be too small to fittingly insert the power components into the housing 1. 102 is the portion in the front of the shrunk opening. The outer diameter is between 25 mm to 28 mm. If the outer diameter being less than 25 mm would be inconvenient to have the opening be shrunk. If the outer diameter is greater than 28 mm, it is not compliant to the industrial standard. 103 is the transition portion from the front of the shrunk opening to the rear of the shrunk opening, which is of an arc shape. Wherein, the length of the transition portion is 1-4 mm. If the length is less than 1 mm, the strength of the shrunk opening is not sufficient. If the length is greater than 4 mm, the length of the end cap 3 would be increased, light emitting surface would be decreased, and material would be waste. Based upon T8 structure and analogously other specifications of T5, T9, or T12 . . . and the like and considering the relation of the thickness of the end cap and the thickness of the hot melt adhesive, the difference of the outer diameters of the main region of the glass tube and the end portion of the shrunk opening should be 2-7 mm or even 1-10 mm. It is noted that the two ends of the housing in the figure are shrunk. But it is not limited to two ends to be shrunk. A case that one end is shrunk and the other end is not shrunk is also included in the claimed scope of the invention (the shrunk opening may be on the end with the power or on the end without the power).

Figure 9:
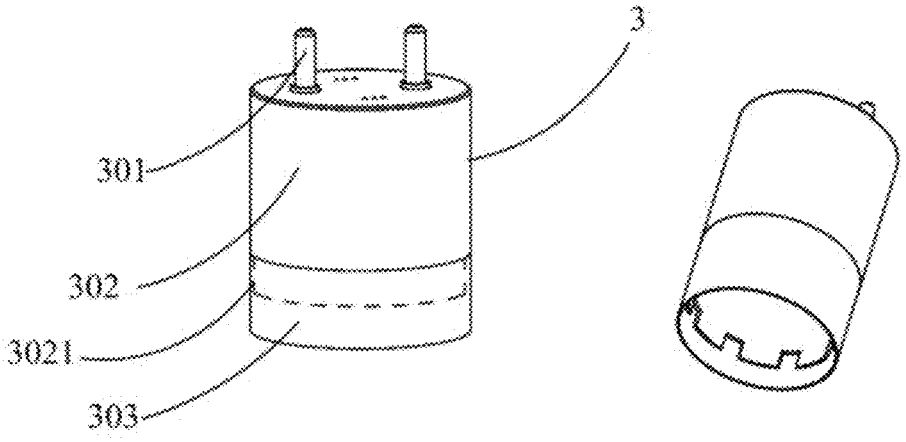
FIG. 9 is a three dimensional schematic view of an end cap of an LED tube lamp according to an embodiment of the invention.
Figure 10:
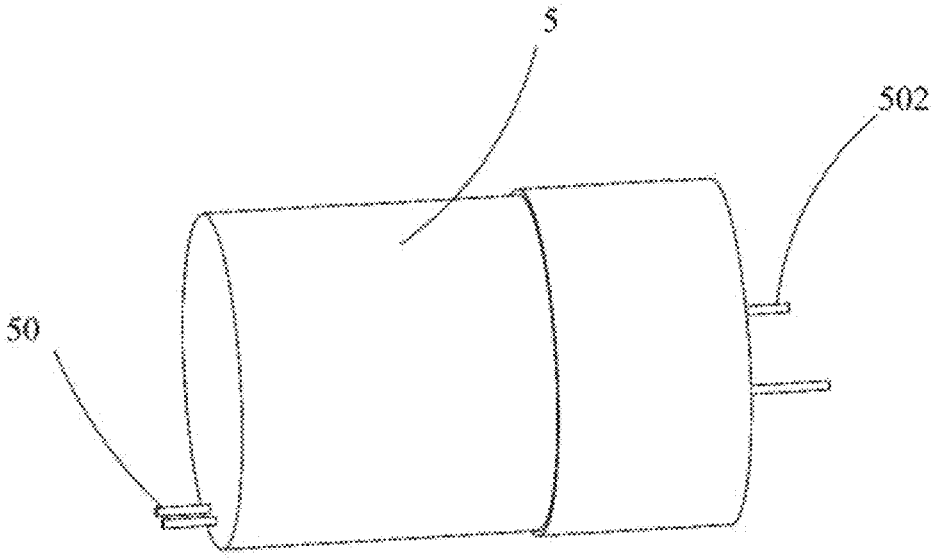
FIG. 10 is a three dimensional schematic view of a power of an LED tube lamp according to an embodiment of the invention.
Figure 11:
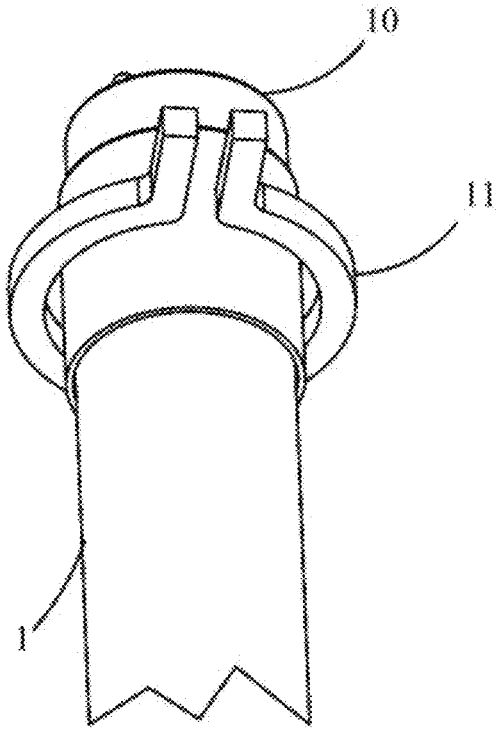
FIG. 11 is a schematic view showing a plastic end cap assembled to a housing of a glass tube sleeved with an induction ring.
Figure 12:
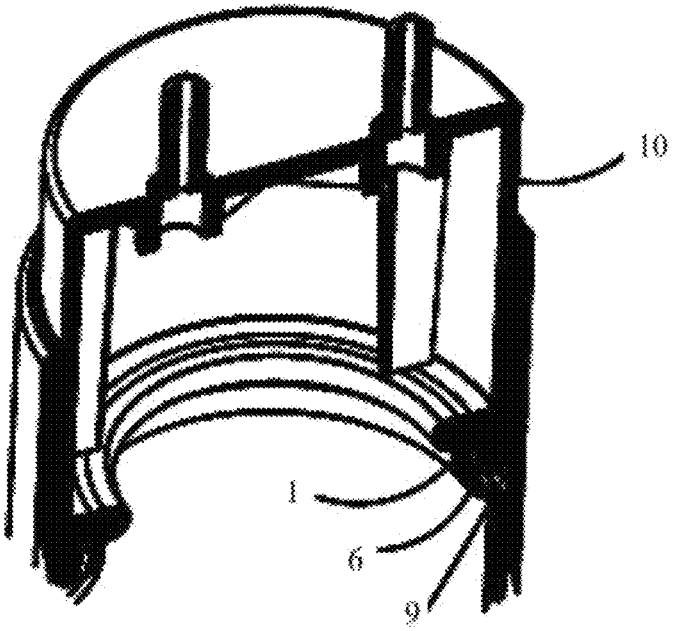
FIG. 12 is a cross sectional view of the plastic end cap of FIG. 6.

In addition, please refer to the three dimensional schematic view of the end cap of FIG. 9. The material of the end cap 3 shown in the figure includes partial plastic and partial metal. Wherein, 302 is the plastic portion, and 3021 is the extending plastic portion. The outer diameter of the plastic portion 302 is 0.15-0.30 mm greater than that of the extending plastic portion 3021. 303 is the metal portion (e.g., aluminum alloy). The proportion of the plastic portion 302 and the metal portion 303 is 2.5:1 to 5:1. In addition, the hollow conductive pin 301 is installed inside the plastic portion 302. An end portion of the housing 1 is inserted to the end cap 3. The position to which the housing 1 is inserted is between ⅓ and ⅔ of the metal portion 303. The advantage is that it won't form a short circuit while the hollow conductive pin is electrified. A creepage distance is increased by the plastic portion. While the end cap is entire aluminum, a bottom portion of the hollow conductive pin 301 needs to be insulated to bear high voltage since the electric current would pass through the hollow conductive pin 301. In the present case, the material of the portion 302 is plastic, which increases a distance between the hollow conductive pin and the metal portion 303 and thus can pass a high voltage test. The end cap 3 is fixed to the end of the housing 1 via the metal portion 303 by the hot melt adhesive 6. By external solidifying equipment, heat can be transferred to it and further transferred to the hot melt adhesive 6 to solidify it and fix the housing 1 and the end cap 3. It is noted that the material of the end cap 3 shown in FIG. 9 including partial plastic and partial metal. In practice, the material may be entire plastic or entire metal. The manner for fixation of the plastic end cap and the housing 1 and be referred to FIGS. 11-12. The steps of the hot melt adhesive 6 being solidified to be connected with the plastic end cap and the housing 1 include: the first step, wherein a magnetic metal member 9 is disposed inside the plastic end cap 10, and the magnetic metal member 9 is placed on a step of the plastic end cap 10; the second step, wherein an inner side of the magnetic metal member 9 is applied with the hot melt adhesive; the third step, wherein the hot melt adhesive 6 is adhered to a peripheral surface around the shrunk opening of the housing 1 of the shrunk glass tube; and the fourth step, wherein the T-LED tube processed with the above steps is disposed in an induction coil 11, such that the magnetic metal member 9 in the plastic end cap 10 and the induction coil 11 are disposed opposite, and the center of the plastic end cap 10 overlaps the center of the induction coil 11 as possible, in which the error is no more than 0.05 mm. Alternatively, by another technique, microwave is controlled to be concentrated closing the magnetic metal member without affection to electric components. The yield rate can be significantly increased. After the above steps are processed, the relation of each component can be referred to FIG. 12. It is noted, the hot melt adhesive 6 is distributed on two sides of the housing 1 of the shrunk glass tube in FIG. 12, and this is a state after the end cap is inserted in the housing 1 of the glass tube. During the insertion of the end cap into the housing 1 of the glass tube, the hot melt adhesive 6 is capable of flowing, and a part of it would be squeezed out of the housing 1 of the glass tube to the other side thereof. The original thickness of the hot melt adhesive is 0.2-0.5 mm. After solidifying, it expands. The manner for fixation of the metal end cap and the housing 1 is the hot melt adhesive 6 being solidified to be connected with the metal end cap and the housing 1 in a conventional thermal conduction manner. It is no need to go into details.

Figure 14:
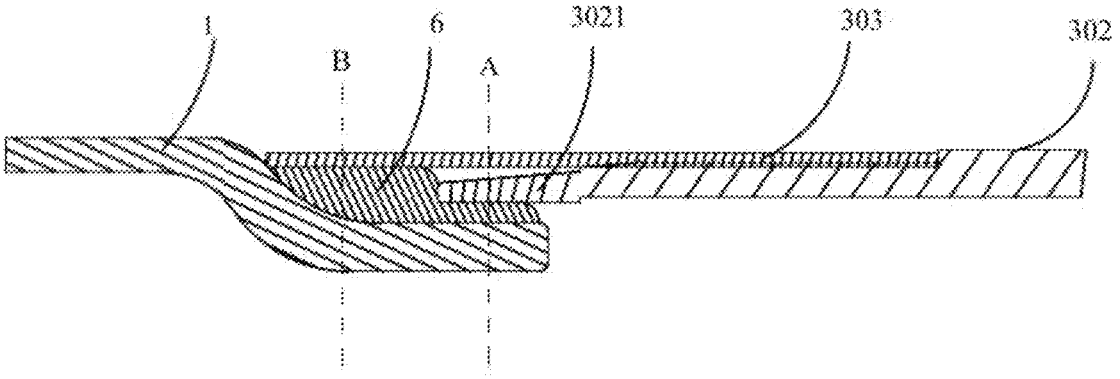
FIG. 14 is a cross sectional view showing the relation of the end cap and the housing after installation.

In addition, please refer to FIG. 14, which illustrates the relation of end cap 3 and the housing 1. The housing 1 inserted in the end cap 3 is shown in FIG. 14. Observing along A direction of the cross sectional view, the components from the outside to the inside in sequence are the metal portion 303 of the end cap 3, the extending plastic portion 3021, the hot melt adhesive 6, and the housing 1. Observing along B direction of the cross sectional view, the components from the outside to the inside in sequence are the metal portion 303 of the end cap 3, the hot melt adhesive 6, and the housing 1.

Figure 13:
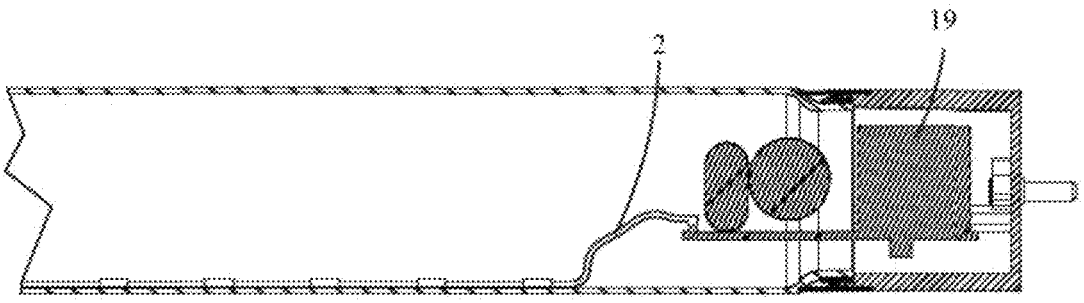
FIG. 13 is a schematic view showing a LED light strip being a flexible substrate directly soldered on an end of the power.

Please refer to FIG. 13. While the LED housing 1 is a shrunk glass tube and the LED power 19 is not a module, i.e., components and circuit board of the power 11 are exposed, it is suitable that the LED light strip 2 is a flexible substrate, and, preferably, the electrical connection of the flexible substrate and the power 11 is to have the flexible substrate pass through the shrunk opening of the glass tube to be connected to an output end of the power. The output end is provided with soldering pads with an amount of tin solder to increase the thickness. The LED light strip 2 also has soldering pads, which are soldered to the soldering pads of an output end of the LED light strip. The advantage is that there is no need of wiring connection, such that the quality of product is stable. As such, the LED light strip 2 has no need of the female plug 201. The flexible substrate has three layers. The upper and lower layers are metal layers. The middle layer is dielectric layer. In such case, it is simplified that only two layers are required. One layer is metal layer for power, and the other layer is dielectric layer. The original metal layer adhered to the bottom of the glass tube can be omitted to form a two-layer structure. A thermal conduction interface is omitted. Moreover, there can be only one power layer. Only wires (copper) are printed thereon. Two thermal conduction interfaces are omitted. The efficiency of LED light source is increased.

Figure 15:
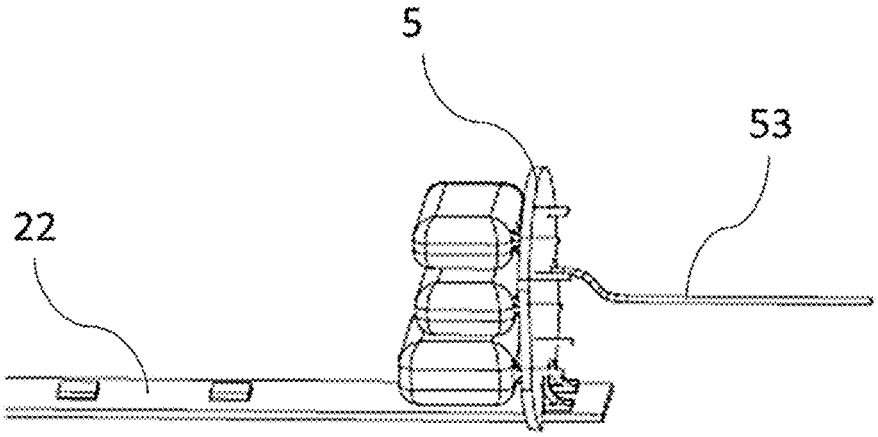
FIG. 15 is a perspective view schematically illustrating the printed circuit board of the power supply is perpendicularly adhered to a hard circuit board made of aluminum via soldering according to another embodiment of the present invention.

Referring to FIG. 15, in one embodiment, the light strip is a hard circuit board 22 made of aluminum, such that the ends thereof can be mounted at ends of the lamp tube 1, and the power supply 5 is soldering bonded to the ends or terminals of the aluminum circuit board 22 in a manner that the printed circuit board of the power supply 5 is perpendicular to the hard circuit board 22. The soldering bonding technique is more convenient to accomplish. In addition, the length of the end cap 3 can be reduced some there is no need of space in the longitudinal direction for the power supply 5. The effective illuminating areas of the LED tube lamp could also increase. Moreover, in the above embodiments, the power supply 5 is not only installed with power supply components but also soldered with other metal wires between the power supply 5 and the hollow conductive pin 301. In the embodiment, a conductive lead 53 could be formed directly on the power supply 5 as a power supply component, which can be used for electrical connection with the end cap 3 without soldering other metal wires. It facilitates and simplifies the manufacturing process.

Figure 16:
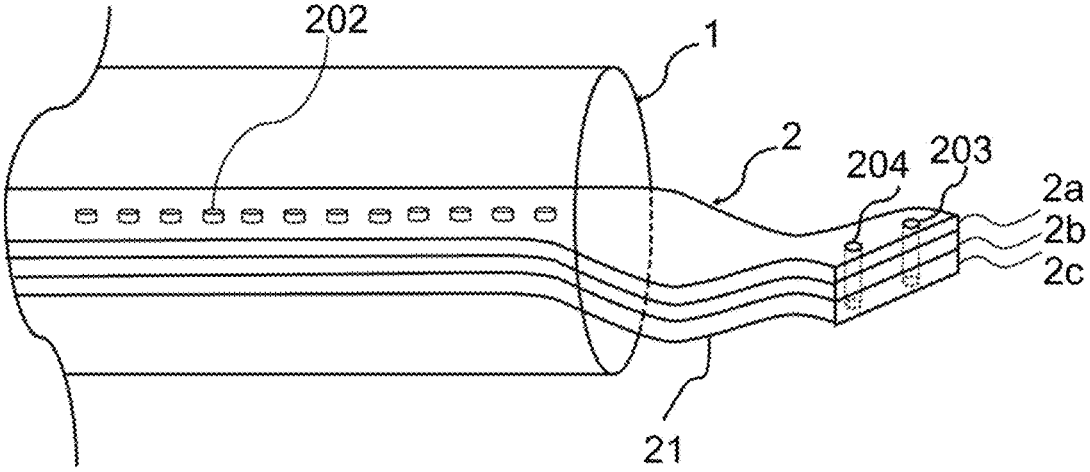
FIG. 16 is a perspective view schematically illustrating the bendable circuit sheet of the LED light strip is formed with two conductive wiring layers according to another embodiment of the present invention.

Referring to FIG. 16, in one embodiment, the LED light strip 2 includes a bendable circuit sheet having in sequence a first wiring layer 2*a*, a dielectric layer 2*b*, and a second wiring layer 2*c*. The thickness of the second wiring layer 2*c* is greater than that of the first wiring layer 2*a*, and the length of the LED light strip 2 is greater than that of the lamp tube 1. The end region of the light strip 2 extending beyond the end portion of the lamp tube 1 without disposition of the light source 202 is formed with two separate through holes 203 and 204 to respectively electrically communicate the first wiring layer 2*a* and the second wiring layer 2*c*. The through holes 203 and 204 are not communicated to each other to avoid short.

When the bendable circuit sheet of the LED light strip 2 includes in sequence the first wiring layer 2*a*, the dielectric layer 2*b*, and the second wiring layer 2*c* as shown in FIG. 16, a freely extending end portions 21 of the LED light strip 2 can be used to accomplish the connection between the first wiring layer 2*a* and the second wiring layer 2*c* and arrange the circuit layout of the power supply 5.

The above-mentioned features of the present invention can be accomplished in any combination to improve the LED tube lamp, and the above embodiments are described by way of example only. The present invention is not herein limited, and many variations are possible without departing from the spirit of the present invention and the scope as defined in the appended claims.

What is claimed is:

1. An LED tube lamp, comprising:
a tube, comprising:
a main body; and
two rear end regions respectively at two ends of the main body, wherein an outer diameter of each of the rear end regions is less than that of the main body;
two end caps respectively sleeving the two rear end regions, each of the end caps comprising:
a metal ring member substantially coaxial with the tube, the metal ring member sleeving the respective rear end region;
an insulating end wall substantially perpendicular to the axial direction of the tube; and
two pins on the insulating end wall for receiving an external driving signal;
an LED light strip disposed on an inner circumferential surface of the main body with a plurality of LED light sources mounted thereon;
a power supply disposed at one end or two ends of the tube and configured to drive the plurality of LED light sources; and
an adhesive disposed between each of the metal ring members and each of the rear end regions;
wherein a rough layer is formed on the inner circumferential surface of the main body and the roughness of the rough layer is higher than that of the outer surface of the main body, so that the light emitted from the LED light sources passing through the rough layer and then through the main body.

2. The LED tube lamp of claim 1, wherein the LED light strip further comprises a mounting region and a connecting region, the plurality of LED light sources are mounted on the mounting region, the connecting region electrically connecting the plurality of LED light sources to the power supply.

3. The LED tube lamp of claim 2, wherein the mounting region is attached on the inner circumferential surface of the main body and the connecting region is detached from the inner surface of the tube to form a freely extending end portion.

4. The LED tube lamp of claim 3, wherein a portion of the freely extending end portion of the LED light strip is in the tube and another portion of the freely extending end portion of the LED light strip is extending beyond an end of the tube and into the end cap.

5. The LED tube lamp of claim 4, wherein the power supply comprises a circuit board, the circuit board being disposed in the end cap, the freely extending end portion of the LED light strip being directly soldered to the circuit board of the power supply.

6. The LED tube lamp of claim 2, wherein the power supply comprises a plurality of electronic components mounted on the connecting region.

7. The LED tube lamp of claim 6, wherein the LED light strip comprises a first wiring layer, a dielectric layer and a second wiring layer, the dielectric layer is disposed between the first wiring layer and the second wiring layer, the plurality of LED light sources are mounted on the first wiring layer.

8. The LED tube lamp of claim 7, wherein the second wiring layer is a piece of metal material and a thickness of the second wiring layer is great than the first wiring layer.

9. The LED tube lamp of claim 8, wherein the LED light strip further comprises a protective layer disposed on the first wiring layer.

10. The LED tube lamp of claim 1, wherein the LED tube lamp further comprises a diffusion film covering the outer surface of the main body, so that the light emitted from the LED light sources passing through the rough layer and then through the diffusion film.

11. The LED tube lamp of claim 10, wherein the LED tube lamp further comprises an adhesive film contained in-between the tube of glass and the diffusion film.

12. The LED tube lamp of claim 10, wherein the tube is a glass tube and the LED tube lamp further comprises an anti-reflection layer coated on the inner surface of the tube which is capable of reducing a reflection occurring at an interface between the glass lamp tube's inner surface and air and allowing more light from the LED light sources transmitting through the glass lamp tube; and wherein the light output from the LED light sources transmits through the anti-reflection layer, the rough layer, the diffusion film, and the tube.

13. An LED tube lamp, comprising:
a tube, comprising:
a main body; and
two rear end regions respectively at two ends of the main body;
two end caps respectively sleeving the two rear end regions, each of the end caps comprising:
a lateral wall substantially coaxial with the tube, the lateral wall sleeving the respective rear end region;
an end wall substantially perpendicular to the axial direction of the tube; and
two pins on the end wall for receiving an external driving signal;
an LED light strip disposed on an inner circumferential surface of the main body with a plurality of LED light sources mounted thereon;
a power supply comprising a circuit board and configured to drive the plurality of LED light sources, the circuit board disposed inside one of the rear end regions and one of the end caps;
an adhesive disposed between each of the lateral wall and each of the rear end regions; and
a diffusion film disposed on the glass lamp tube so that light emitted from the LED light sources passing through the inner surface of the glass lamp tube and then passing through the diffusion film on the glass lamp tube.

14. The LED tube lamp of claim 13, wherein a portion of the circuit board, one of the rear end regions, the adhesive and one of the lateral wall are stacked sequentially in a radial direction of the LED tube lamp.

15. The LED tube lamp of claim 14, wherein an outer diameter of each of the rear end regions is less than the outer diameter of the main body.

16. The LED tube lamp of claim 14, wherein the LED light strip further comprises a mounting region and a connecting region, the plurality of LED light sources are mounted on the mounting region, the connecting region electrically connecting the plurality of LED light sources to the power supply.

17. The LED tube lamp of claim 16, wherein the mounting region is attached on the inner circumferential surface of the main body and the connecting region is detached from the inner surface of the tube to form a freely extending end portion.

18. The LED tube lamp of claim 17, wherein the freely extending end portion of the LED light strip is directly soldered to the circuit board of the power supply.

19. The LED tube lamp of claim 14, wherein the LED light strip comprises a first wiring layer, a dielectric layer and a second wiring layer, the dielectric layer is disposed between the first wiring layer and the second wiring layer, and the plurality of LED light sources are mounted on the first wiring layer.

20. The LED tube lamp of claim 19, wherein the second wiring layer is a piece of metal material and the thickness of the second wiring layer is great than the first wiring layer.

21. The LED tube lamp of claim 20, wherein the LED light strip further comprises a protective layer disposed on the first wiring layer.

22. The LED tube lamp of claim 14, wherein the LED tube lamp further comprises an adhesive film contained in-between the glass lamp tube and the diffusion film.

23. The LED tube lamp of claim 14, wherein the LED tube lamp further comprises an anti-reflection layer coated on the inner surface of the tube.

* * * * *